US005640072A

United States Patent [19]

Miyazaki et al.

[11] Patent Number: 5,640,072

[45] Date of Patent: Jun. 17, 1997

[54] METHOD OF AUTOMATICALLY CONTROLLING THE OPENING AND CLOSING OF WINDOW OF DRIVER'S CAB OF WORKING VEHICLE AND APPARATUS FOR PRACTICING THE METHOD

[75] Inventors: Masamichi Miyazaki, Osaka; Yoshihiro Nagata, Zyoyo, both of Japan

[73] Assignee: Kōmatsu Ltd., Tokyo, Japan

[21] Appl. No.: 530,219

[22] PCT Filed: Mar. 31, 1994

[86] PCT No.: PCT/JP94/00534

§ 371 Date: Sep. 29, 1995

§ 102(e) Date: Sep. 29, 1995

[87] PCT Pub. No.: WO94/23138

PCT Pub. Date: Oct. 13, 1994

[30] Foreign Application Priority Data

| | | | |
|---|---|---|---|
| Mar. 31, 1993 | [JP] | Japan | 5-098568 |
| Mar. 31, 1993 | [JP] | Japan | 5-098569 |
| Mar. 31, 1993 | [JP] | Japan | 5-098570 |

[51] Int. Cl.[6] ..... E02F 9/16

[52] U.S. Cl. ..... 318/282; 318/466; 318/468

[58] Field of Search ..... 318/260–283, 318/430–479, 139; 49/227, 28, 352, 349, 502, 377, 441, 490; 74/89.2, 89.22; 180/287; 307/9, 10

[56] References Cited

U.S. PATENT DOCUMENTS

| | | | |
|---|---|---|---|
| 4,650,242 | 3/1987 | Obe et al. | 180/89.12 |
| 4,878,391 | 11/1989 | Komatsu et al. | 74/89.2 |
| 5,174,066 | 12/1992 | Dupuy | 49/502 |
| 5,381,065 | 1/1995 | Jones | 318/468 |
| 5,404,673 | 4/1995 | Takeda et al. | 318/282 |
| 5,422,551 | 6/1995 | Takeda et al. | 318/265 |
| 5,521,473 | 5/1996 | Mizuno et al. | 318/285 |

FOREIGN PATENT DOCUMENTS

| | | |
|---|---|---|
| 61-64981 | 4/1986 | Japan . |
| 63-142179 | 6/1988 | Japan . |
| 4-11184 | 1/1992 | Japan . |
| 4-208632 | 7/1992 | Japan . |
| 4-365619 | 12/1992 | Japan . |
| 5-4516 | 1/1993 | Japan . |

*Primary Examiner*—Paul Ip
*Attorney, Agent, or Firm*—Sidley & Austin

[57] ABSTRACT

A method of automatically controlling the opening and closing of the window of the driver's cab of a working vehicle, and an apparatus for practicing the same method, are capable of carrying out the opening and closing of such a window smoothly and the shutting of such a window reliably, and have a high operability and a high safety. To obtain such effects, the apparatus is provided with a window (14) movable along guide rails (20L, 20R, 22L, 22R) extending between a window frame (16) and a top wall (18), a driving cable (28) for moving the window (14) vertically by operating a driving means (34), locking units (29L, 29R) adapted to press the window (14) against the window frame (16) of the driver's cab (12) and shut the same, and a controller (50) for controlling these operations. In this apparatus, the locking units (29L, 29R) are provided with means (47L, 47R) for detecting a terminal position for a downward movement of the window (14) during a window closing operation, a circuit (56) for detecting a locking motor driving current during a window shutting operation, and means (48L, 48R) for detecting limit positions for backward movements of locking members (44L, 44R) during a window shutting force releasing operation; and the controller (50) is provided with a delay circuit (59), an element (54) for eliminating slack in the driving cable, an element (53) for shutting up the window (14), and a window shutting force releasing element (52).

27 Claims, 19 Drawing Sheets

TIMING CHART OF WINDOW OPENING OPERATION

FIG. 22
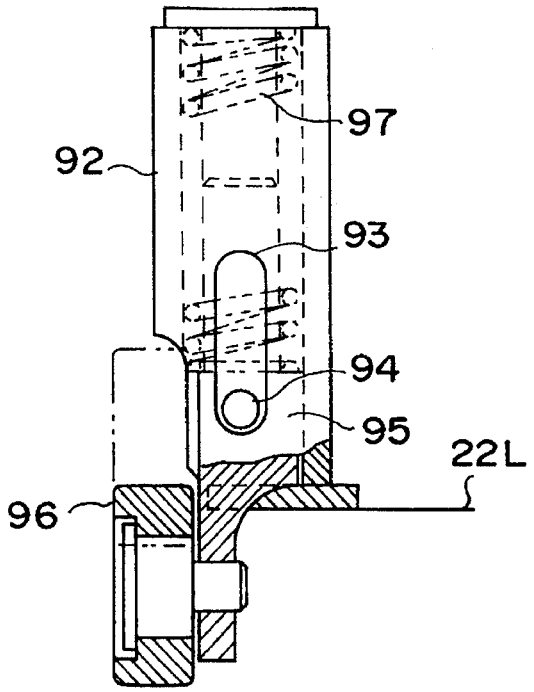
FIG. 23a
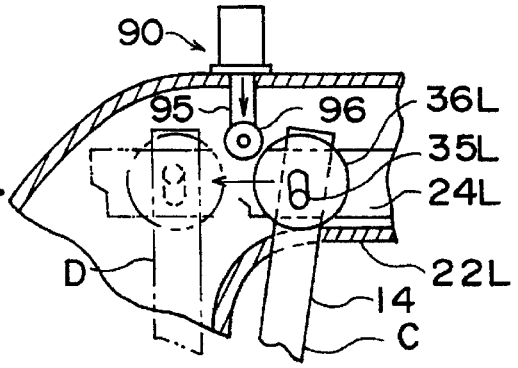
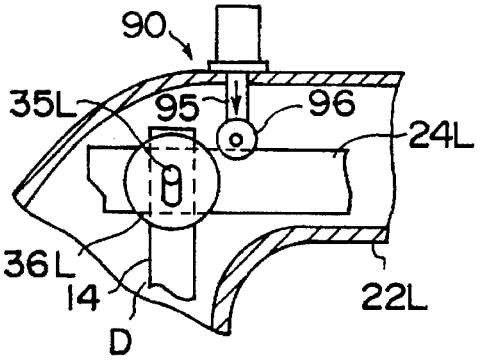
FIG. 23c
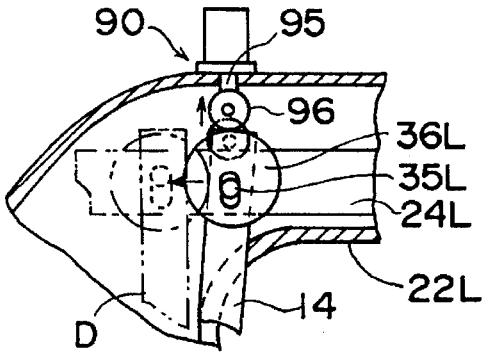
FIG. 23b

METHOD OF AUTOMATICALLY CONTROLLING THE OPENING AND CLOSING OF WINDOW OF DRIVER'S CAB OF WORKING VEHICLE AND APPARATUS FOR PRACTICING THE METHOD

BACKGROUND OF THE INVENTION

Field of the Invention

This invention relates to a method of automatically controlling the opening and closing of the window of the driver's cab of a working vehicle and to an apparatus for practicing the method. More particularly, it relates to a method of automatically controlling the opening and closing of the window of the driver's cab of a working vehicle, which is suitable for the opening and closing of the front window of the driver's cab of a construction machine, such as a hydraulic shovel, crane or the like, and to an apparatus for practicing the method.

Prior Art

In a construction machine, such as a hydraulic shovel, crane or the like, the front door (to be referred to as "window" hereinafter) can be opened and closed for direct confirmation of the working ground, direct communication with an assistant worker, and the like. That is, guide rails extending to the top wall are provided on the window frame of the driver's cab so that the window is moved upwardly when it is removed from the window frame by pulling it from the window frame of the driver's cab toward the driver, and is moved along the guide rails until it becomes parallel to the top wall. This operation is performed manually by the driver holding one of the grips provided on the top and bottom of the window.

Since the weight of the window is about 20 kg, it is not easy for the driver to open and close the window. Further, as each guide rail is shaped almost like a turned letter L, it is difficult to move the window smoothly along a bent portion of the guide rail, and the driver must open and close the window in an unnatural posture. Therefore, the inventors of the present invention have proposed an apparatus for opening and closing the window in which guide rails for moving the window up and down are provided both on the window frame and on the top wall, rollers which roll along the guide rails are provided in the four corners of the window, a driving cable provided with a wire ring to form a closed loop is connected to the window, and the window is opened and closed by the drive force of a motor for circulating the driving cable (Japanese Patent Laid-Open (A) 3-141896). The opening operation of this window is accomplished as follows. A motor driving switch is first turned on to rotate the motor, and the window is pulled upwardly by the driving cable and stored in the guide rails on the top wall. The closing operation of the window is accomplished as follows. The window is moved downwardly along the guide rails on the window frame from the top wall by the reverse rotation of the motor, pressed against the window frame by means of locking units when it reaches the terminal position of its downward movement, and tightly closed. Each locking unit is structured such that it engages with a locking pin provided on the window only at the time of locking so that it does not interfere with the movement of the window during the window opening and closing operations. That is, the locking unit has a threaded rod driven by the motor, a movable nut mounted on the threaded rod, and an engaging portion moving with the movable nut and movable up and down so that the engaging portion moves down and engages with the pin provided on the window at the same time the movable nut moves in a locking operation direction.

However, since there is a small gap between the terminal position for the downward movement of the window and the shutting locking position in the locking unit, there is a possibility that, when the window reaches the terminal position of its downward movement, it vibrates and the locking operation is not performed smoothly. In other words, there is the problem that the shutting operation cannot be performed since the engaging portion of the locking unit starts the locking operation without engaging with the locking pin, due to the vibration of the window.

Further, since the driving cable has play allowance, when the window reaches the terminal position of its downward movement, slack is generated by a continuation of the feeding of the driving cable. As a result, a delay occurs during the window opening operation, and the window moves against the intention of the driver, providing a feeling of disorder. At the same time, the driving cable can fall off from the guide rail to disable the opening and closing operations of the window.

Further, the locking operation or the release operation of the window by means of the locking units is stopped by setting a rotation time of the motor or the like. Since the right and left distances of the window's movement upwardly to the locking position differ according to the production accuracy of the window frame, there is a problem in that the locking unit stops under an unbalanced condition.

Moreover, an ON/OFF switch unit is employed for the conventional opening and closing operations of the window so that the operation switch is pressed one time toward the closing operation side to move the window downwardly for a closing operation and the locking units are activated to shut the window. Similarly, for an opening operation, the operation switch is pressed one time toward the opening operation side to move the window upwardly and to store it in the top wall.

When the driver performs the operation of a working machine during the opening or closing operation of the window, there is the possibility that the machine goes wrong, the driver is caught between the window and the window frame, or the operation of the working machine is neglected when there is an abnormality in the opening or closing operation of the window, thereby causing an accident. In this way, the opening and closing operations of the window might not be performed in accordance with the intention of the driver and there is a problem in securing safety.

Moreover, to prevent temperatures inside the driver's cab from elevating abnormally during work in summer, the driver can open and close the window manually. However, in recent years, the driver has opened and closed the window electrically (refer to Japanese Patent Laid-Open (A) 4-11184 and Japanese Patent Laid-Open (A) 4-208632, for example). In this instance, a geared cable 28*a* and a return cable 28*b* constituting the driving cable 28 for the window, are interconnected by a coupler 100L as shown in FIG. 24*a*. As for details of this interconnection, an end portion of the geared cable 28*a* is fixed to the coupler 100L and an end portion of the return cable 28*b* is inserted into a hole in the coupler 100L and formed into a loop, as shown in FIG. 24*b*.

However, since there is such a forming step in the installation of the window in the driver's cab, it takes a lot of time and labor to interconnect these cables and assemble the window. There is the problem that a bend is generated by the load of the window during the opening or closing operation, and the durability of the window is lowered since the geared cable 28*a* and the return cable 28*b* cannot be rotated independently.

Further, the locking unit of an apparatus for automatically controlling the opening and closing of the window has been proposed (refer to Japanese Patent Laid-Open (A) 4-365619, for example). However, the locking unit 29L, as shown in FIG. 25, has the following problem. When the window 14 is to be closed while the vehicle is going down a slope with a gradient α, the locking member 44L is disengaged from the locking pin 35L by the weight generated by the inclination of the window 14, and the window 14 moves from the shutting standby position C to the shut position D by itself. Therefore, engagement at the shut position D cannot be carried out, and the subsequent opening operation of the window cannot be performed as well.

SUMMARY OF THE INVENTION

In view of the above problems of the prior art, it is an object of the present invention to provide a method of automatically controlling the opening and closing of the window of the driver's cab of a working vehicle and an apparatus for practicing the method, which are capable of carrying out the opening and closing operations of the window of the driver's cab of the working vehicle smoothly and of reliably stopping the operation of the locking units, which disable the simultaneous operation of the working machine during the opening or closing operation of the window, thereby providing a high operability and a high safety, and which facilitates the interconnection assembly of the driving cable.

According to the present invention, in the method of automatically controlling the opening and closing of the window, the window of the driver's cab of a working vehicle is provided between a window frame and a top wall of the driver's cab in such a manner that it can be driven vertically by a driving cable, the window is moved vertically by turning on an operation switch and is pressed against the window frame by the locking units during a window closing operation, and the locking units are caused to perform a window shutting operation immediately after a terminal position for the downward movement of the window during a window closing operation is detected by detection means, or a predetermined time lag is provided by a delay circuit before the locking units are caused to perform a window shutting operation. This shutting operation is interrupted and the driving cable is wound up to remove slack in the driving cable.

Further, a locking motor driving current in the locking unit during a window shutting operation is detected by a detection circuit, a locking motor is stopped during the window shutting operation when the load current of the detection circuit exceeds a threshold value, limit positions for the backward movements of the locking members of the locking units during a window shutting force releasing operation are detected by detection means, and the backwardly moving locking motors are stopped to release the window shutting force when the limit positions for backward movements of the locking members are detected. The locking units press the right and left upper portions of the window independently, and detect the right and left locking motor driving currents corresponding thereto independently, as well as detect the limit positions for the backward movements of the locking members to stop the right and left locking motors independently.

Further, a driving current of the driving means for the driving cable during the vertical movement of the window is detected by a detection circuit so that, a predetermined time after a load current from this detection circuit exceeds a threshold value, the driving means is stopped by a safety circuit.

Moreover, an operation switch, formed of a deadman switch circuit, is turned on for a window opening or closing operation, and a switch operation signal output circuit and a relay circuit are operated to cut off a hydraulic circuit of the working machine while the operation switch is on, so that the opening or closing operation of the window and the operation of the working machine can be selectively performed.

According to the present invention, in an apparatus for automatically controlling the opening and closing of the window and having guide rails formed between the window frame of the driver's cab of the working vehicle and the top wall of the driver's cab, a window movable along the guide rails, a driving cable, connected to the window and circulated by means of the driving means, for moving the window vertically, locking units for pressing the window against the window frame to shut the window, and a controller for controlling these operations, the locking units are each provided with detection means for detecting the terminal position for the downward movement of the window during a window closing operation, and the controller is provided with a delay circuit for providing a predetermined time lag after the terminal position for the downward movement of the window is detected by the detection means so that a window shutting operation is performed by the locking units through this delay circuit.

The controller is also provided with a driving cable slack eliminating element, for interrupting the window shutting operation and outputting a window wind-up signal to the driving means.

Further, each of the locking units is provided with a detection circuit, for detecting a locking motor driving current during a window shutting operation, and a detection means, for detecting the limit position for the backward movement of the locking member during a window shutting force releasing operation; and the controller is provided with a shutting element, for outputting a drive signal to the locking motor and for outputting a stop signal to the locking motor when the load current of the detection circuit exceeds a threshold value, and a shutting force releasing element, for outputting a stop signal to the locking motor which moves back when the limit position for the backward movement of the locking member is detected by the detection means. The locking units are provided on the right and left upper portions of the window in such a manner that they can press the window, and each comprises a detection circuit for detecting a locking motor driving current and detection means for detecting the limit position for the backward movement of the locking member, so that the locking motors of the respective locking units are stopped independently by the shutting element and the shutting force releasing element.

The driving means is provided with a detection circuit for detecting a driving current during the upward movement of the window; and the controller is provided with a safety circuit, for outputting a stop signal to the driving means when a load current from the detection circuit exceeds a threshold value, an alarm circuit for outputting an alarm signal to an alarm, and a cut circuit for preventing the driving means from stopping during a predetermined time after the activation, even when a load current exceeds a threshold value.

Further, each locking unit is provided with a detection means for detecting the terminal position for the downward movement of the window during a window closing operation, a detection circuit for detecting a locking motor driving current during a window shutting operation, and a detection means for detecting the limit positions for the backward movements of the locking members during a window shutting force releasing operation; and the controller is provided with a delay circuit for providing a predetermined time lag after the terminal position for the downward movement of the window is detected by the detection means, a driving cable slack eliminating element for outputting a window wind-up signal to the driving means by interrupting the window shutting operation of the locking units, a shutting element for outputting a stop signal to the locking motors when the locking motor load current of the detection circuit during a window shutting operation exceeds a threshold value, and a shutting force releasing element for outputting a stop signal to the locking motors which move back when the limit positions for the backward movements of the locking members during the window shutting force releasing operation are detected. The controller is provided with a detection means for detecting the terminal position for the downward movement of the window, or the detection means for detecting the limit positions for the backward movements of the locking members is provided with a malfunction decision circuit.

Further, the operation switch for turning on the apparatus, for automatically controlling the opening and closing of the window, is formed of a deadman switch circuit; and a switch operation signal output circuit, for cutting off the hydraulic circuit of the working machine of the above working vehicle by turning on the operation switch, and a relay circuit are provided to selectively perform the opening or closing operation of the window and the operation of the working machine. The controller comprises an alarm circuit which is activated when the input of the operation switch stops in the course of the opening or closing operation of the window.

An end portion of the geared cable of the driving cable is connected to a grommet, an end portion of the return cable of the driving cable is connected to a cable end ball, the grommet and the cable end ball are supported by the head portion of a pin inserted into the hole of the grommet and one end of a boss provided around the pin, the other end of the boss is fixed to the window, and a roller is rotatably installed around the boss.

When the locking pin of a slide plate, provided on an upper end of the window, is engaged with the locking member of the locking unit and the window is pressed to the shut position from the shutting standby position, a detent unit, for keeping the engagement between the locking pin and the locking member, is provided on an upper rim of the guide rail at the shutting standby position. This detent unit includes a case installed upright on the upper rim of the guide rail, a leg loosely installed in the case so that it can go in and out of a lower portion of the case, and a detent roller supported at a lower end of the leg so that the detent roller can move vertically.

According to the above structure, the locking units are activated a predetermined time after the terminal position for the downward movement of the window is detected by the detection means. Therefore, when the window reaches the terminal position of its downward movement and vibrates in the gap between the terminal position and the shut position, the locking units can start the engaging operation with the locking pins after the vibration ends. Therefore, the window shutting operation is performed without failure.

Since a driving cable wind-up operation is performed by interrupting the shutting operation of the locking units, the slack in the driving cable can be removed. Therefore, as the driving cable can be wound up immediately without falling off of the guide rail, the operability is good and operations without a feeling of disorder are possible.

Moreover, since the locking units are provided on both of the right and left sides of the window and can be activated and stopped independently, the window can be closed tightly with respect to the window frame without being shut only on one side.

Since the backwardly moving locking motors are stopped when the limit positions for the backward movements of the locking members are detected during a window shutting force releasing operation, it is possible to prevent an excess current from flowing into the locking motors without failure when the locking members are stopped by mechanical contact, thereby improving the durability of the locking motors. Since the vertical movement of the window is stopped a predetermined time after the load current of the driving means exceeds a threshold value and an alarm is given, safety is secured even when the driver is caught between the window and the window frame during a window opening or closing operation, and an alarm is not given when an overload current is detected at the time of activation.

Further, since the operation switch operates only when it is kept pressed toward the opening operation side or the closing operation side, the driver can recognize that the automatic opening or closing operation of the window is currently being performed. Since the hydraulic circuit of the working machine is cut off during the operation of the operation switch, the simultaneous operation of the window and the working machine is impossible, thereby preventing the occurrence of a danger not only to the driver but also to the third party. A high safety is provided, for example, when the opening or closing operation of the window is interrupted, in that an alarm is given.

A forming step at the time of assembly is not required as an end portion of the return cable can be connected to the cable end ball before assembly, thereby making assembly work extremely easy.

Since the detent unit, for keeping engagement between the locking pin and the locking member when the window is pressed from the shutting standby position to the shut position, is provided on the upper rim of the guide rail at the shutting standby position, the detent roller keeps this engagement, thereby making it possible to shut or release the window without a problem even if the engagement is released by the weight generated by the inclination of the window when the vehicle is moving downwardly.

BRIEF DESCRIPTION OF THE DRAWINGS

FIG. 22 is a partly broken side view of the detent unit;

FIGS. 23*a*, 23*b* and 23*c* are diagrams explaining the function of the detect unit;

DETAILED DESCRIPTION OF THE PREFERRED EMBODIMENT

A first embodiment of the present invention is described in detail with reference to FIGS. 1 to 13.

Figure 8:
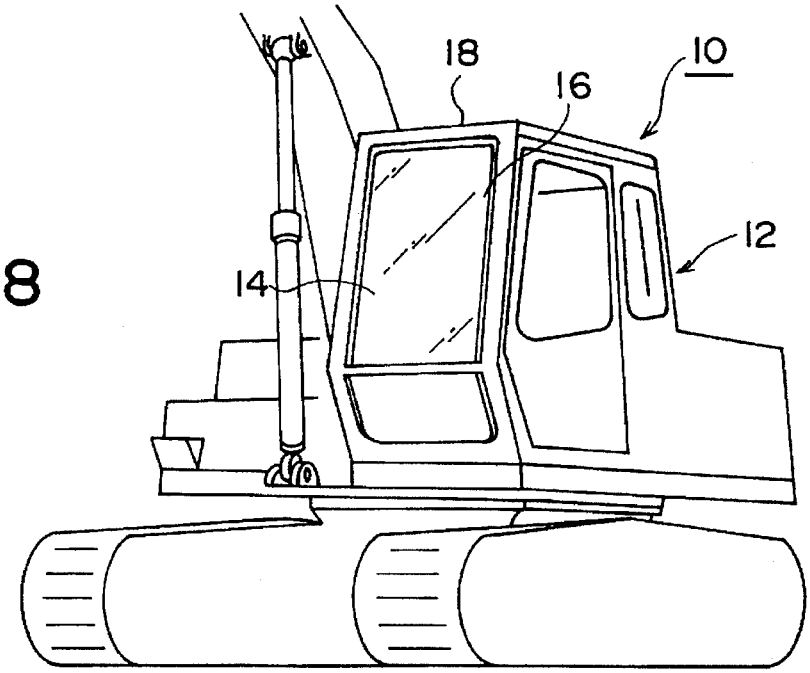
FIG. 8 is a diagram for explaining a working vehicle equipped with the apparatus for automatically controlling the opening and closing of the window.

FIG. 8 shows the outer appearance of a hydraulic shovel 10 as a working vehicle. A window 14, installed at the front of a driver's cab 12, can automatically move vertically between a window frame 16 and a top wall 18.

Figure 9:
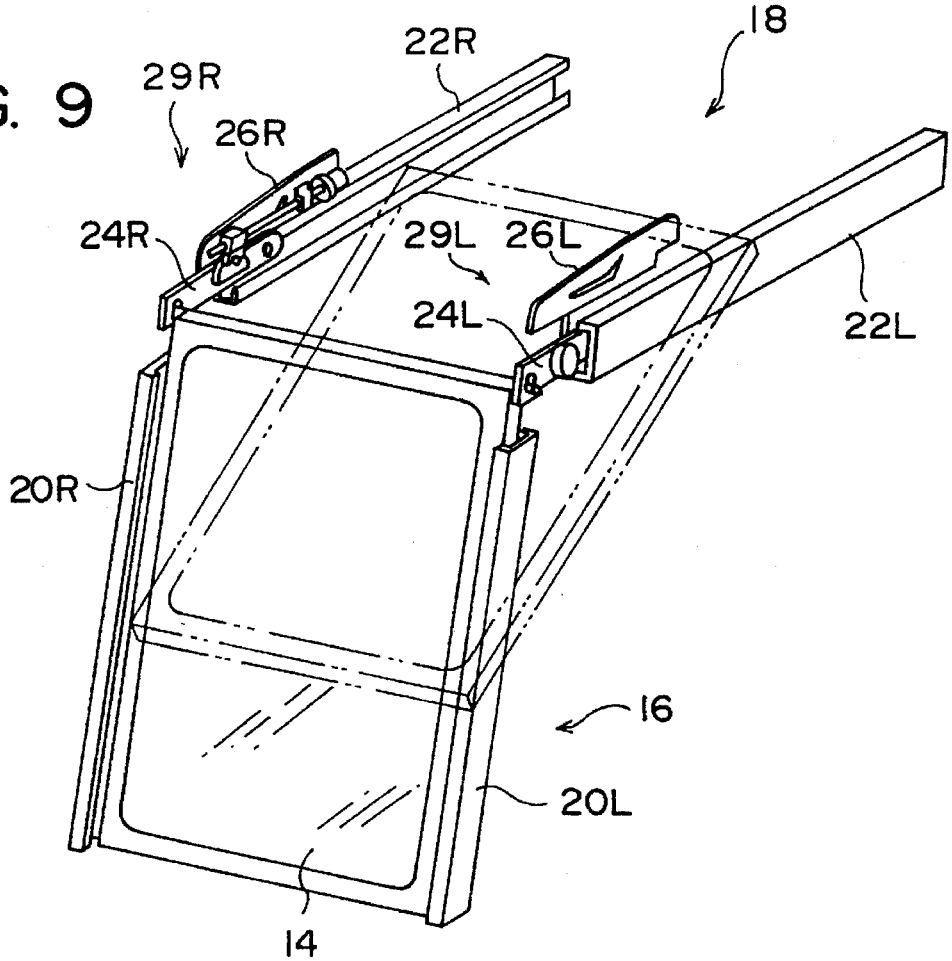
FIG. 9 is a diagram for explaining the window opening and closing operations.

As shown in FIG. 9, a pair of guide rails 20L and 20R are provided on the window frame 16 and another pair of guide rails 22L and 22R are provided on the top wall 18. The window 14 is automatically moved vertically along these guide rails 20L, 20R, 22L and 22R. Slide plates 24L and 24R, accommodated in the guide rails 22L and 22R on the top wall 18, are installed on the left and right upper portions of the window 14, respectively. The slide plates 24L and 24R are driven in a forward direction when shutting the window 14 by means of the pressing means 26L and 26R, arranged on upper portions of the guide rails 22L and 22R, respectively. The locking units 29L and 29R for the window 14 are constituted by the slide plates 24L and 24R and the pressing means 26L and 26R, respectively.

Figure 10:
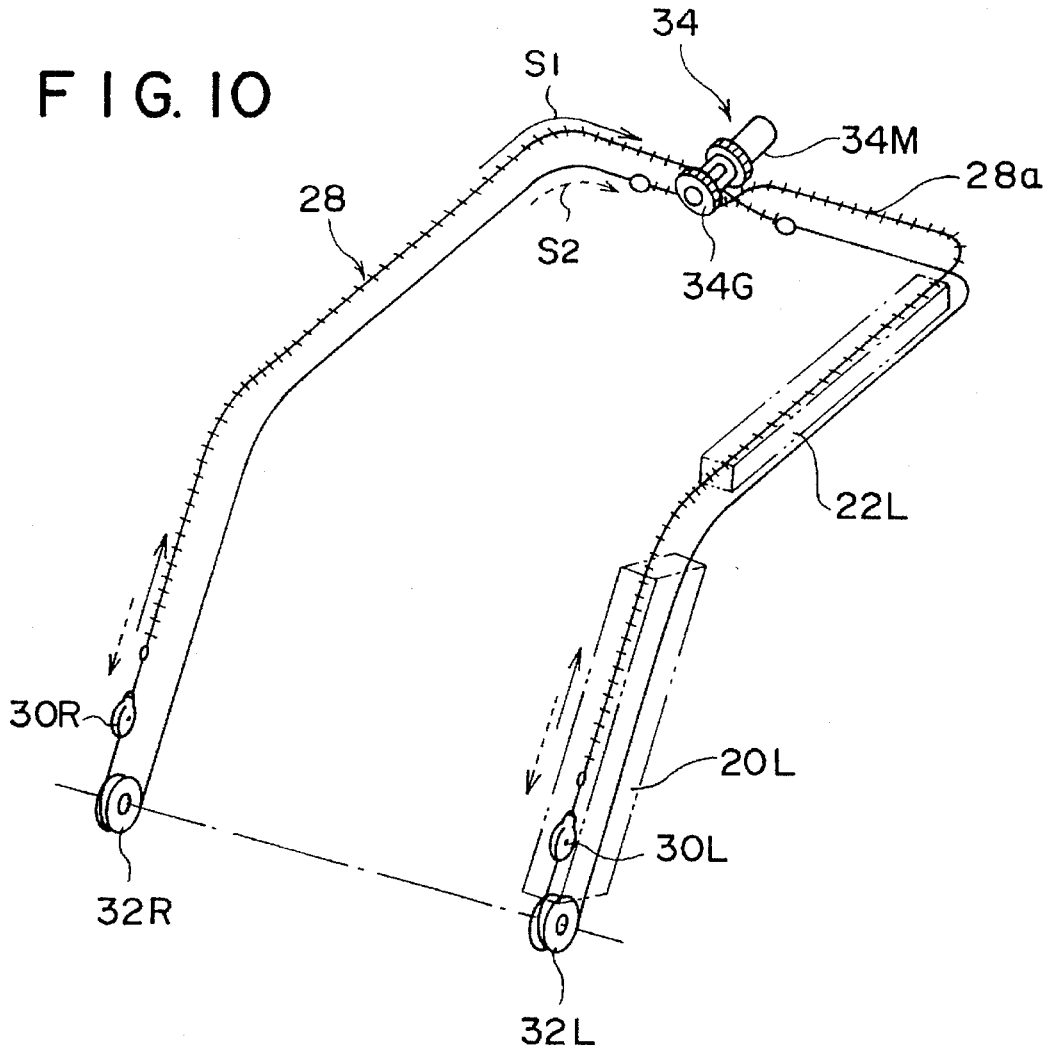
FIG. 10 is a diagram for explaining the driving cable of the window.

To move the window 14 vertically, a driving cable 28, forming a closed loop, is connected to the window 14 as shown in FIG. 10. That is, two end portions of the driving cable 28 are connected to the couplers 30L and 30R, which are fixed to the left and right lower ends of the window 14. The other end portions of the driving cable are extended along the guide rails 20L, 20R, 22L and 22R, caused to cross each other at the back of the top wall 18, extended downwardly on opposite sides, turned back through idler rollers 32L and 32R, provided at a downward position of the window frame 16, and connected to the couplers 30L and 30R. A driving unit 34 is provided at the crossing of the driving cable 28, as driving means to circulate the driving cable 28. A part of the driving cable 28 is a geared cable 28*a*, and the driving unit 34 is constituted by a gear 34G, arranged to engage with the geared cable 28*a*, and a lifting motor 34M for rotating the gear 34G. The couplers 30L and 30R are pulled upwardly, as shown by a solid line arrow S1, by rotating the lifting motor 34M, and are pulled downwardly, as shown by a broken line arrow S2, by rotating the lifting motor 34M in the reverse direction. With the circulating movement of the driving cable 28, the opening or closing operation of the window 14 is effected.

Figure 11:
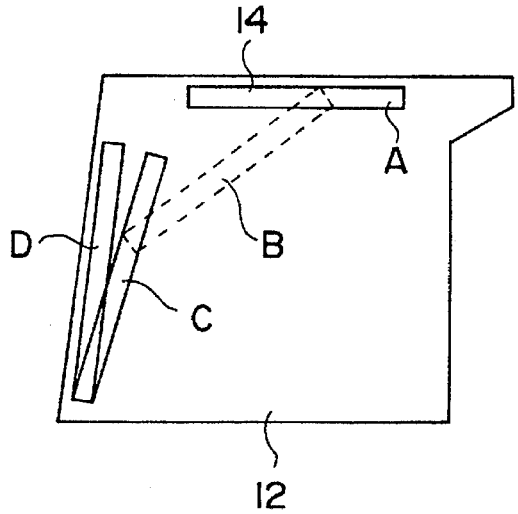
FIG. 11 is a diagram for explaining window operation states.

The opened and closed states of the window 14 are shown in FIG. 11. The fully opened state of the window 14 is state A, in which the window 14 is along the guide rails 22L and 22R of the top wall 18; an intermediate state of the window 14 is state B, shown by a broken line in which an upper end portion of the window 14 is located on the guide rails 22L and 22R of the top wall 18 and a lower end portion of the window 14 is located on the guide rails 20L and 20R of the window frame 16; the shutting standby state is state C, in which both of the upper and lower portions of the window 14 are held in the guide rails 20L and 20R of the window frame 16; and the shut state is state D, in which the left and right upper end portions of the window 14 are pressed against the window frame 16 by the left and right locking units 29L and 29R to fix the window 14.

Figure 12:
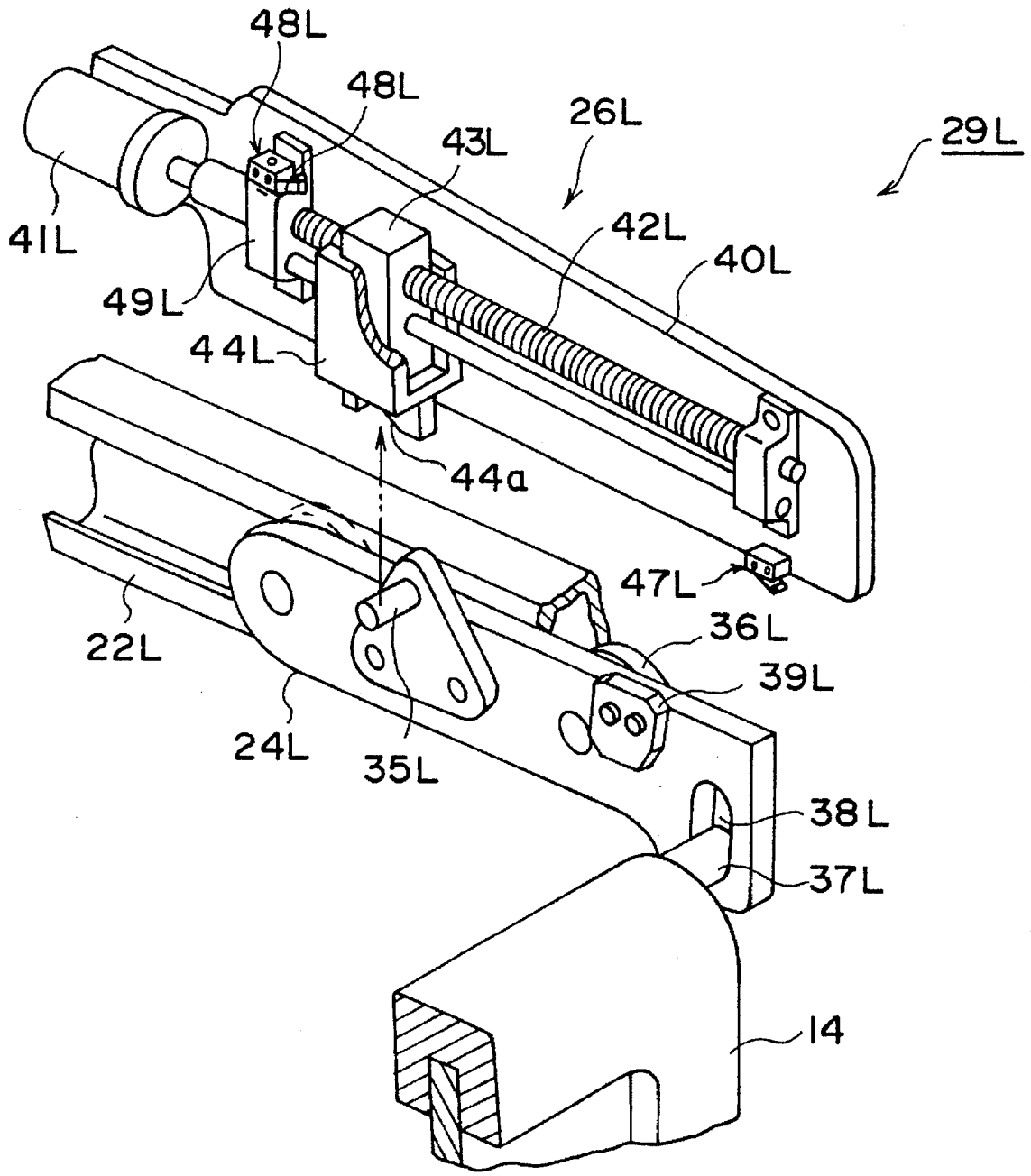
FIG. 12 is an exploded perspective view of a locking unit.
Figure 13:
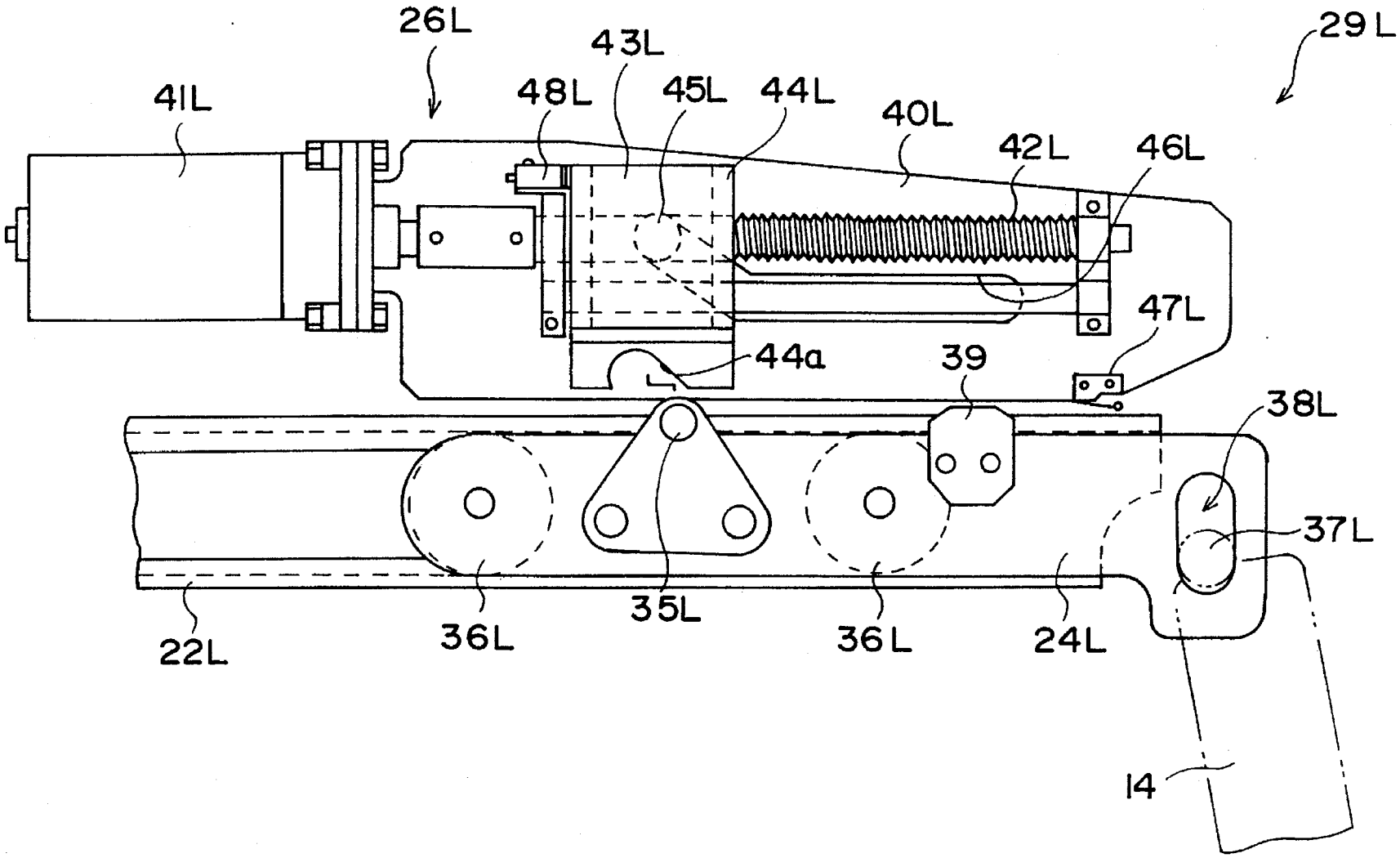
FIG. 13 is a side view of the locking unit.

Details of the left locking unit 29L are shown in FIGS. 12 and 13 as an example of the left and right locking units 29L and 29R. A roller 36L is provided on one side of the slide plate 24L and is guided along the guide rail 22L of the top wall 18. An elongated hole 38L is formed in an end portion of the slide plate 24L, and a coupling shaft 37L, projecting from an upper end of the window 14, is inserted into the hole 38L to interconnect the slide plate 24L and the window 14. Meanwhile, the pressing means 26L is 35 arranged on an upper portion of the slide plate 24L and has a cam plate 40L arranged in the same plane as the slide plate 24L. On one side of the cam plate 40L, a locking motor 41L and a threaded rod 42L, rotated by the locking motor 41L, are installed. The threaded rod 42L is fitted with a movable nut 43L, and a vertically movable locking member 44L is attached to the movable nut 43L. The locking member 44L has a cam pin 45L, which projects toward the direction of the thickness of the cam plate 40L and which fits in a cam hole 46L provided in the cam plate 40L. The cam hole 46L is shaped such that the locking member 44L, at the limit position of its backward movement, can move downwardly on a slope in the forward direction and then move forward horizontally. The slide plate 24L is provided with a locking pin 35L to perform a shutting operation, and a locking groove **44*a* is formed on an under surface of the locking member 44L. Thereby, the locking member 44L engages with the locking pin 35L when moving downwardly in a forward direction from the limit position of its backward movement. Thereafter, the slide plate 24L is forced to move forwardly with the advance of the locking member 44L so that an upper end portion of the window 14 is pressed against the window frame 16 to tightly close the window 14. The opening operation of the window 14** is performed by reversing the above operation.

Figure 1:
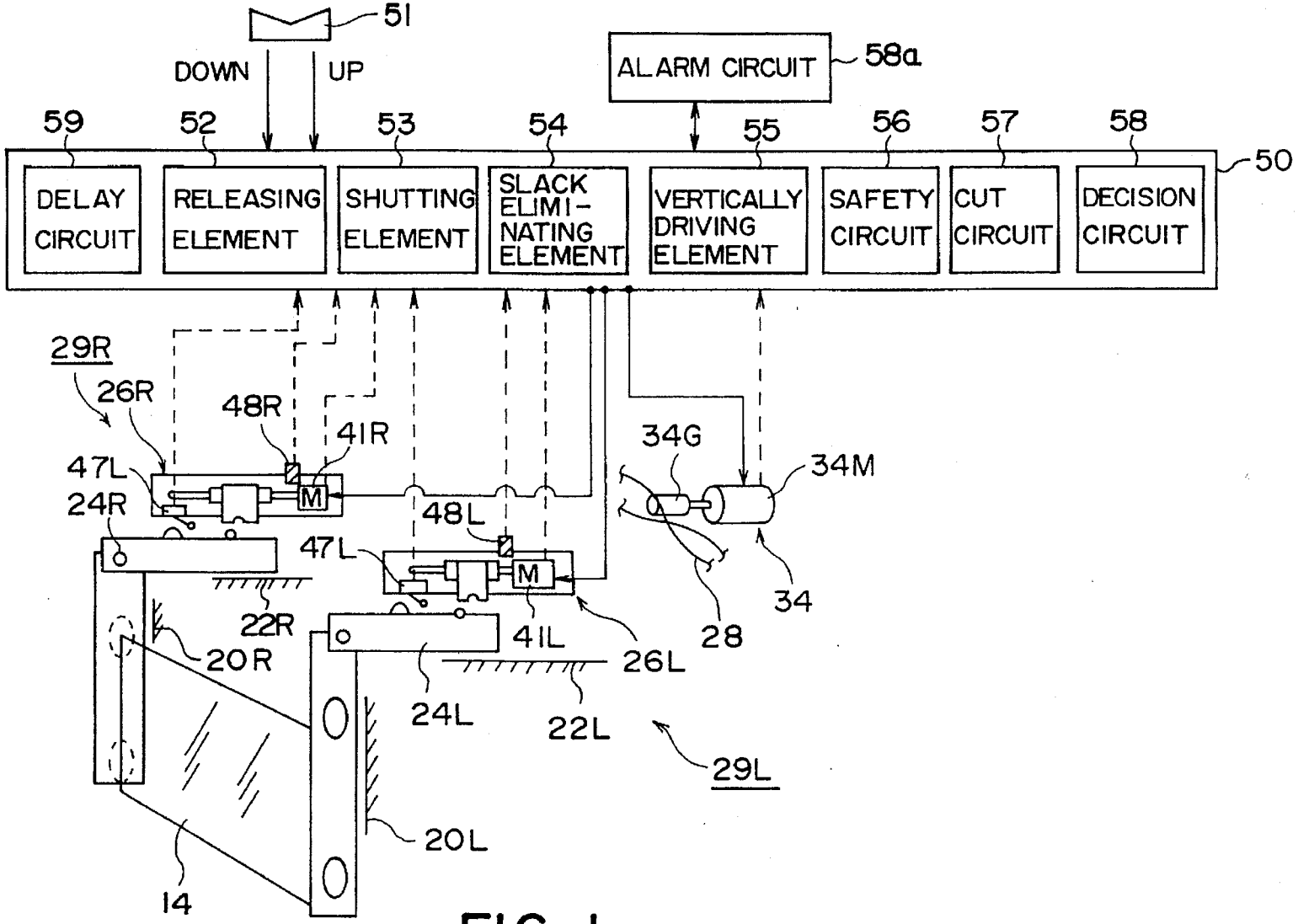
FIG. 1 is a schematic diagram of the configuration of an apparatus for automatically controlling the opening and closing of a window according to a first embodiment of the present invention.

FIG. 1 shows a schematic configuration of an apparatus for automatically and optimally controlling the opening and closing operations of the window. A controller 50, for controlling the opening and closing operations of the window 14, is caused to receive an operation signal from the operation switch 51, which performs a selection operation for selecting an opening operation (UP) or closing operation (DOWN) of the window 14. According to the input direction of the operation signal for the opening operation or closing operation, the controller 50 outputs to the lifting motor 34M a signal for circulating the driving cable 28.

A signal for detecting that the window 14 has reached the terminal position of its downward movement by the closing operation and is in the shutting standby state C, a signal for detecting the shut state D in which the pressing means 26L and 26R have moved the slide plates 24L and 24R forwardly, and a signal for detecting that the locking members 44L and 44R have moved back, disengaged from the locking pin 35L and 35R and reached the limit positions of their backward movements, are applied to the controller 50.

First, the fact, that the window 14 has been moved downwardly from the open state A to the terminal position of its downward movement by the closing operation and is in the shutting standby state C, is mechanically detected by the left and right limit switches 47L and 47R, as detection means for detecting the terminal position for the downward movement of the window 14, and their detection signals are applied to the controller 50. This arrangement is shown in FIGS. 12 and 13 by taking a left side of the apparatus as an example. The limit switch 47L is attached to a lower end portion of the cam plate 40L of the pressing means 26L. The switch piece of the limit switch 47L faces the slide plate 24L, and a striker 39L, for turning on the switch piece at a position where the window 14 reaches the terminal position of its downward movement, is installed on the slide plate 24L. Therefore, the slide plate 24L moves forwardly along with the downward movement of the window 14, and when the window 14 reaches the terminal position of its downward movement, the striker 39L turns on the limit switch 47L. The limit switch 47L can be suitably installed on the window 14, a member moving together with the window 14, or members on the driver's cab corresponding to these. A signal, indicating that the terminal position for the downward movement of the window 14 is detected by means of the limit switch 47L, is used by the controller 50 for securing the operation of the locking unit 29L as described hereinafter. An unshown limit switch, for detecting that the window 14 is stored in the top wall 18 by the opening operation of the window 14, is provided to detect the terminal position for the backward movement of the window 14.

Further, a signal, indicating that the locking member 44L has reached the limit position of its forward movement or the limit position of its backward movement, is applied to the controller 50. Particularly, that the locking member 44L reaches the limit position of its backward movement, that is, the shutting force releasing position, is detected by the limit switch 48L. In other words, the limit switch 48L is mounted on a bearing 49L at the back of the threaded rod 42L, and its switch piece is arranged to be turned on at a position immediately before the rear surface of the locking member 44L contacts the bearing 49L.

Meanwhile, the fact that the locking member 44L reaches the limit position of its forward movement, that is, the shut position D, is detected by detecting the load current of the locking motor 41L by means of a detection circuit connected to the locking motor 41L. That is, when the window 14 is pushed forwardly toward the window frame 16, the contact pressure between rubber seals provided on both the window 14 and the window frame 16 increases, whereby the moving resistance of the movable nut 43L increases and the load current of the locking motor 41L rises. As a result, a so-called surge current is generated. The determination of the limit position for the forward movement of the locking member 44L is performed by detecting that the surge current exceeds a predetermined threshold value.

The controller 50, which receives these detection signals, performs various processings by means of the shutting force releasing element 52, the shutting element 53, the driving cable slack eliminating element 54, and the vertically driving element 55, as shown in FIG. 1. The contents of each processing are described based on the charts of FIGS. 2 to 7.

Figure 2:
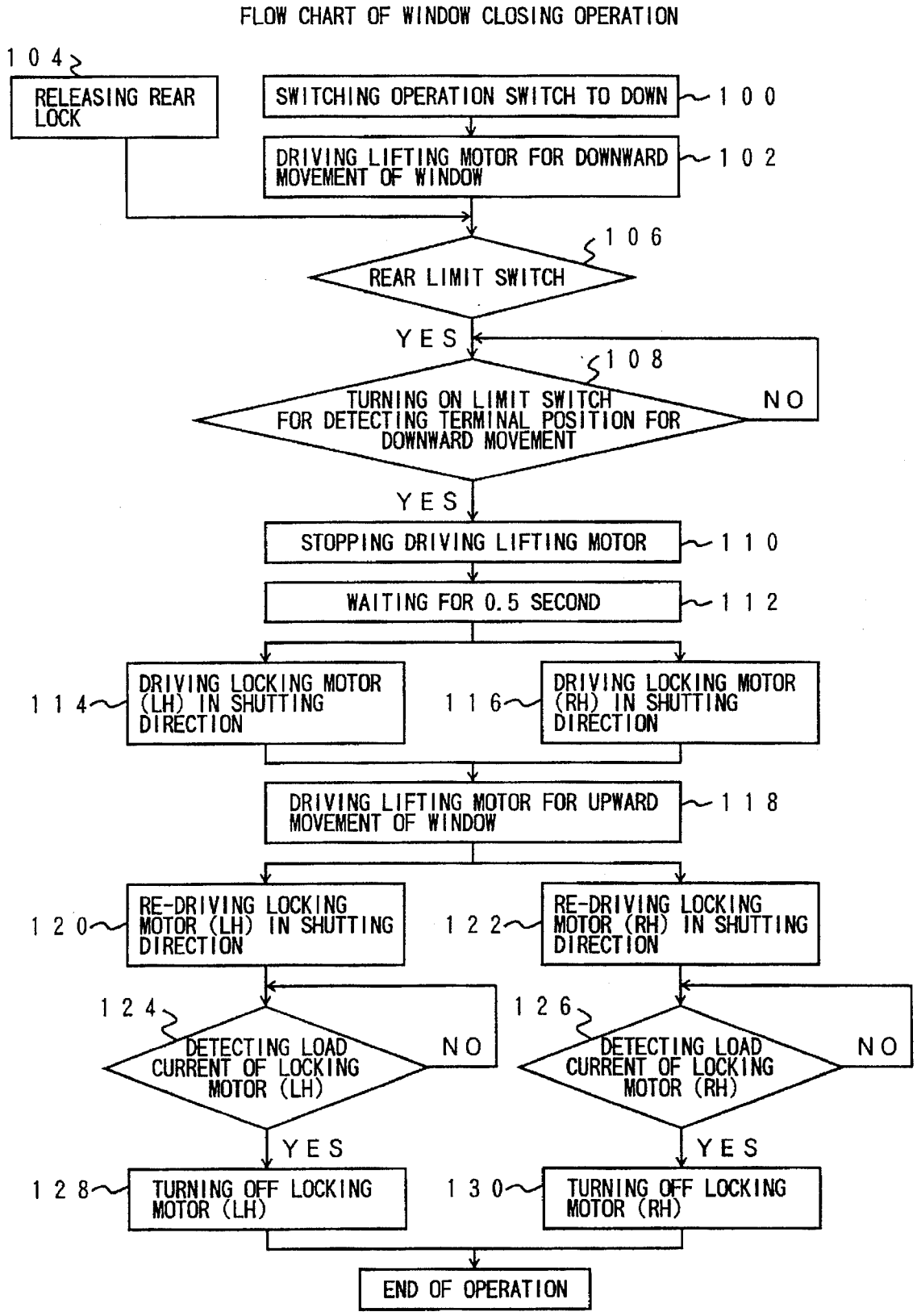
FIG. 2 is a flow chart of a window closing operation.

The closing operation of the window 14 is described with reference to FIG. 2. When the operation switch 51 is switched to DOWN (step 100), the motor 34M of the driving cable 28 is activated to move the window 14 downwardly (step 102). At this point, an unshown rear lock, which holds the window 14 at the open position, is released (step 104). It is confirmed that the window 14 is separated from an unshown rear limit switch provided on the top wall 18 (step 106), and the downward movement of the window 14 is continued until the terminal position for the downward movement of the window 14 is detected by the limit switches 47L and 47R (step 108). When it is detected that the window 14 has reached the terminal position of its downward movement, the vertically driving element 55 of the controller 50 immediately outputs a stop instruction to the lifting motor 34M to stop the movement of the window 14 (step 110). Therefore, an overload on the motor 34M is prevented.

Thereafter, the shutting operation for pressing the window 14 against the window frame 16 is performed by the shutting element 53. Prior to this, a predetermined time lag is set, i.e., the window 14 is pressed against the window frame 16 after 0.5 second (step 112). This prevents inconvenience, such as a failure of engagement of each of the locking units 29L and 29R, caused by an extremely small vibration which is generated immediately after the window 14 reaches the terminal position of its downward movement. The time lag can be easily set by providing a delay circuit 59 in the controller 50.

After an elapse of the time lag, the locking motors 41L and 41R are driven for about 1 second to rotate the threaded rods 42L and 42R and move the movable nuts 43L and 43R forwardly, whereby the locking members 44L and 44R move downwardly and engage with the locking pins 35L and 35R of the slide plates 24L and 24R, respectively. During this time, the shutting operation of the window 14 is interrupted (steps 114 and 116). The slack eliminating element 54 of the controller 50, which receives an interruption signal, generates an output for driving the lifting motor 34M for the upward movement of the window 14 for about 0.1 second to remove slack in the driving cable 28 (step 118). At this point, since the locking members 44L and 44R are held by the threaded rods 42L and 42R, locking is not undone even if the amount of cable movement is too large.

Subsequently, the shutting element 53 re-drives the locking motors 41L and 41R to advance the slide plates 24L and 24R, respectively (steps 120 and 122). At this point, the load currents of the locking motors 41L and 41R are applied to the shutting element 53 to be compared with a preset threshold value (steps 124 and 126). When it is detected that the load currents exceed the threshold value, the locking motors 41L and 41R are stopped (steps 128 and 130) to shut the window 14 without failure.

Figure 3:
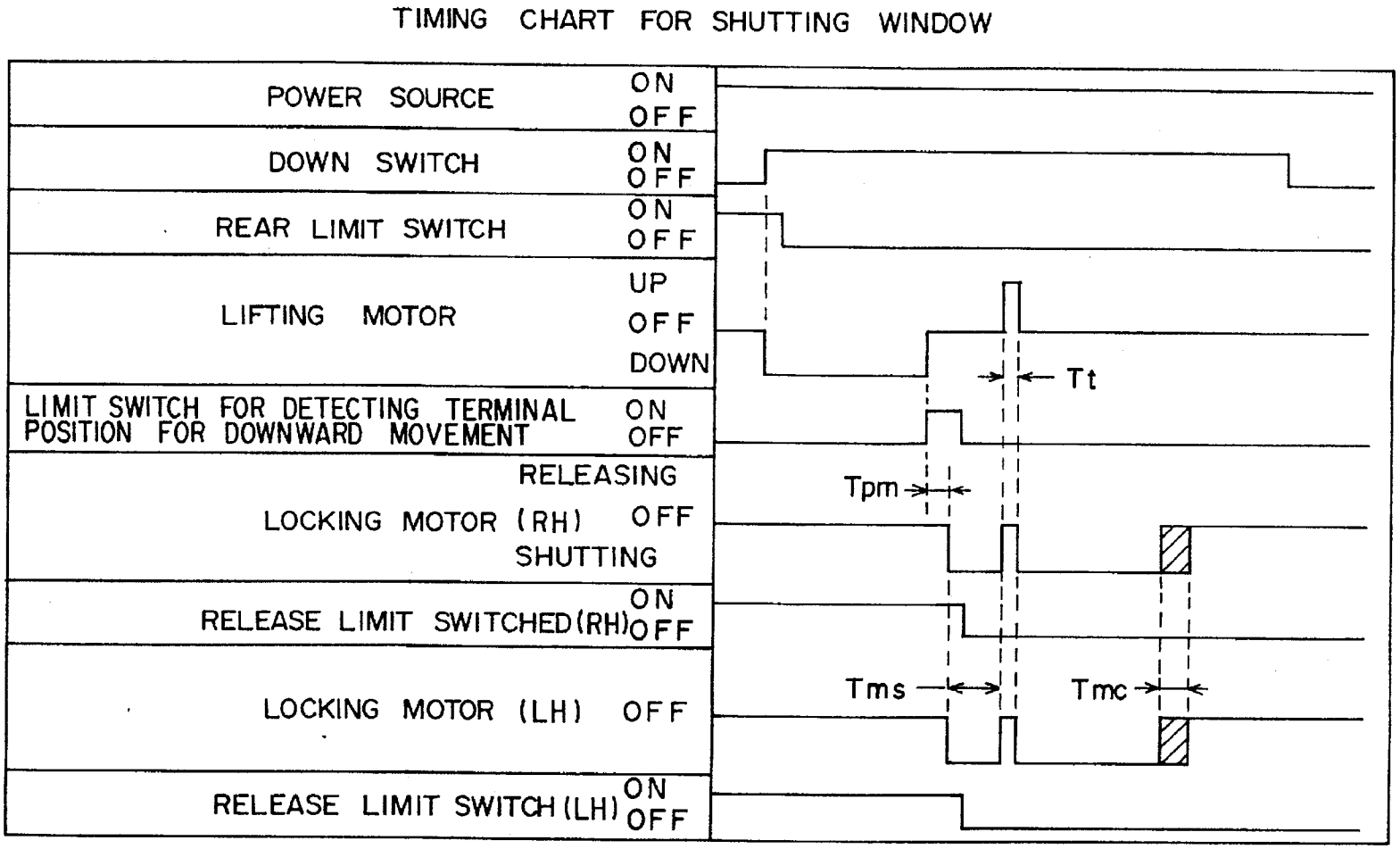
FIG. 3 is a timing chart of the window closing operation.

A timing chart for the closing operation of the window 14 is shown in FIG. 3. Tpm is a time required for the convergence of vibration when the window 14 reaches the terminal position of its downward movement, Tms is a time elapsed until the locking members 44L and 44R engage with the locking pins 35L and 35L, respectively, Tt is a time required to eliminate slack in the cable, and Tmc is a time elapsed until a load current beyond a rated current is generated in the locking motors 41L and 41R and a surge current beyond a predetermined value is detected.

Figure 4:
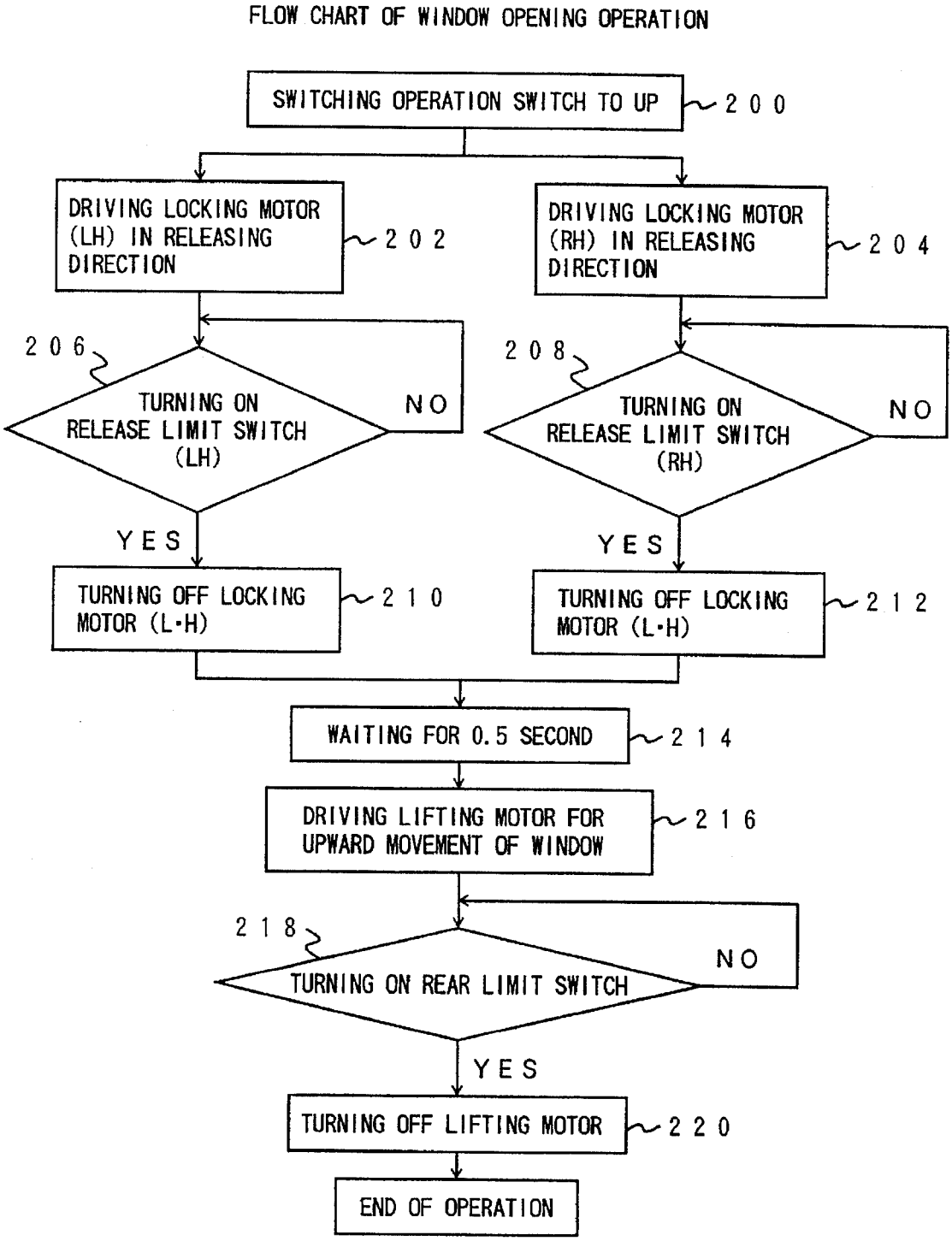
FIG. 4 is a flow chart of a window opening operation.

A description of the opening operation of the window 14 is set forth with reference to FIG. 4. When the operation switch 51 is switched to UP (step 200), the locking motors 41L and 41R are reversely driven to move back the movable nuts 43L and 43R, which are located at the limit positions of their forward movements (steps 202 and 204). Thereby, the locking members 44L and 44R move the slide plates 24L and 24R, respectively, backwardly to separate an upper end portion of the window 14 from the window frame 16. When the movable nuts 43L and 43R move backwardly subsequently, the locking members 44L and 44R are moved upwardly along cam holes 46L and 46R while moving backwardly. As the result, the locking members 44L and 44R are disengaged from the slide plates 24L and 24R, respectively. Due to the backward movement of the locking members 44L and 44R, the switch pieces of the locking release limit switches 48L and 48R, arranged at the limit positions of their backward movements, are turned on, which is detected by the shutting force releasing element 52 (steps 206 and 208). The shutting force releasing element 52 outputs a stop instruction to the locking motors 41L and 41R, which are moving backwardly, to stop the motors (steps 210 and 212). When the upper end portion of the window 14 is released thereby, the driving cable 28 and the window 14 are held on standby for about 0.5 second until the vibration state is converged, because the driving cable 28 and the upper end portion of the window 14 might vibrate (step 214). Subsequently, the processing is transferred to the vertically driving element 55, which drives the lifting motor 34M in a cable winding-up direction (step 216). Thereby, the window 14 is moved upwardly and is stored in the top wall 18. An unshown rear limit switch is provided at the storage position, it is detected whether the switch is turned on or not (step 218), the rear lock is locked at the same time the switch is turned on, and the lifting motor 34M is stopped (step 220) to complete the opening operation.

Figure 5:
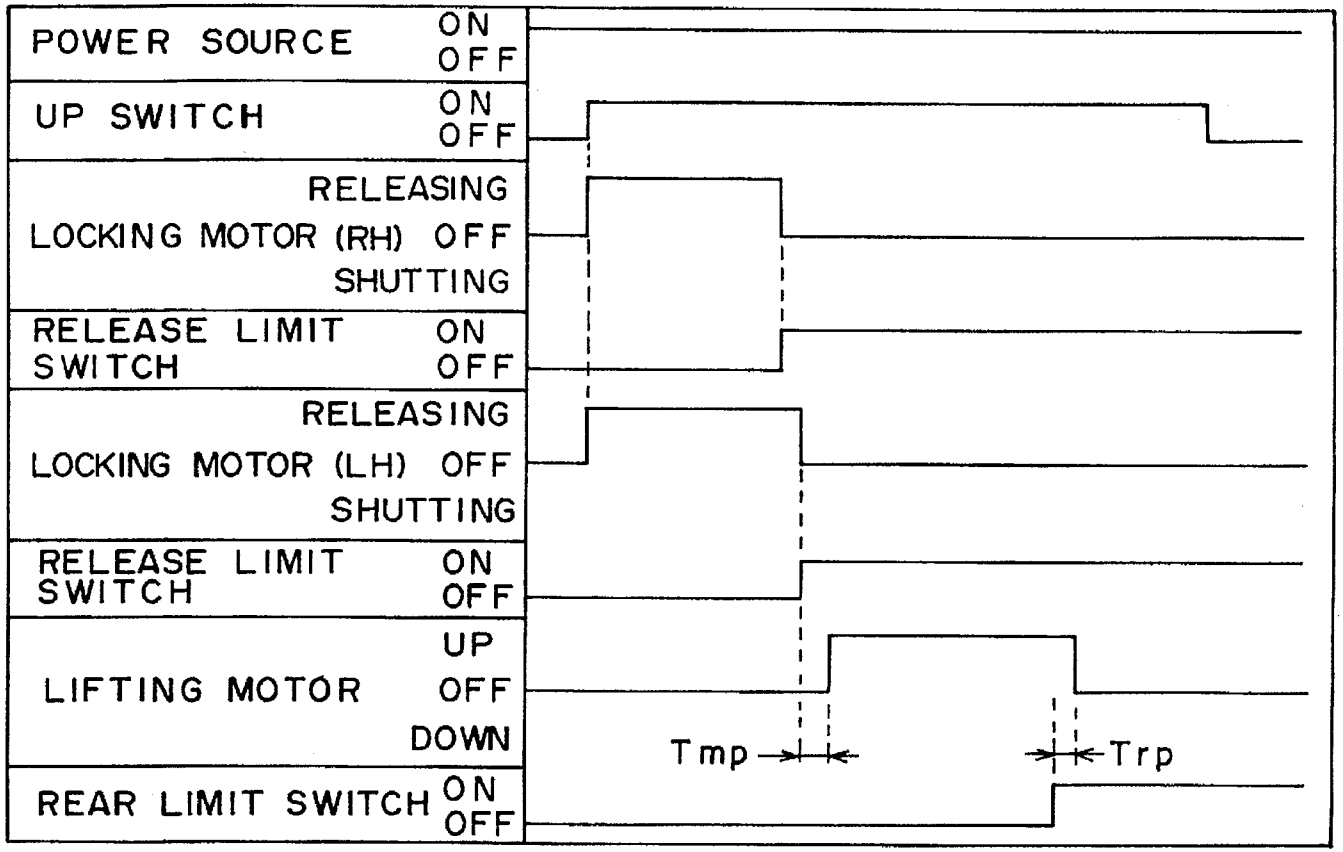
FIG. 5 is a timing chart of the window opening operation.

A timing chart for this opening operation is shown in FIG. 5. In this chart, Tpm is a standby time elapsed from the unlocking of the window 14 to the convergence of vibration, and Trp is a delay time elapsed from the time when the window 14 is stored in the top wall and the rear limit switch is turned on to the time when the lifting motor 34M is stopped.

Figure 6A:
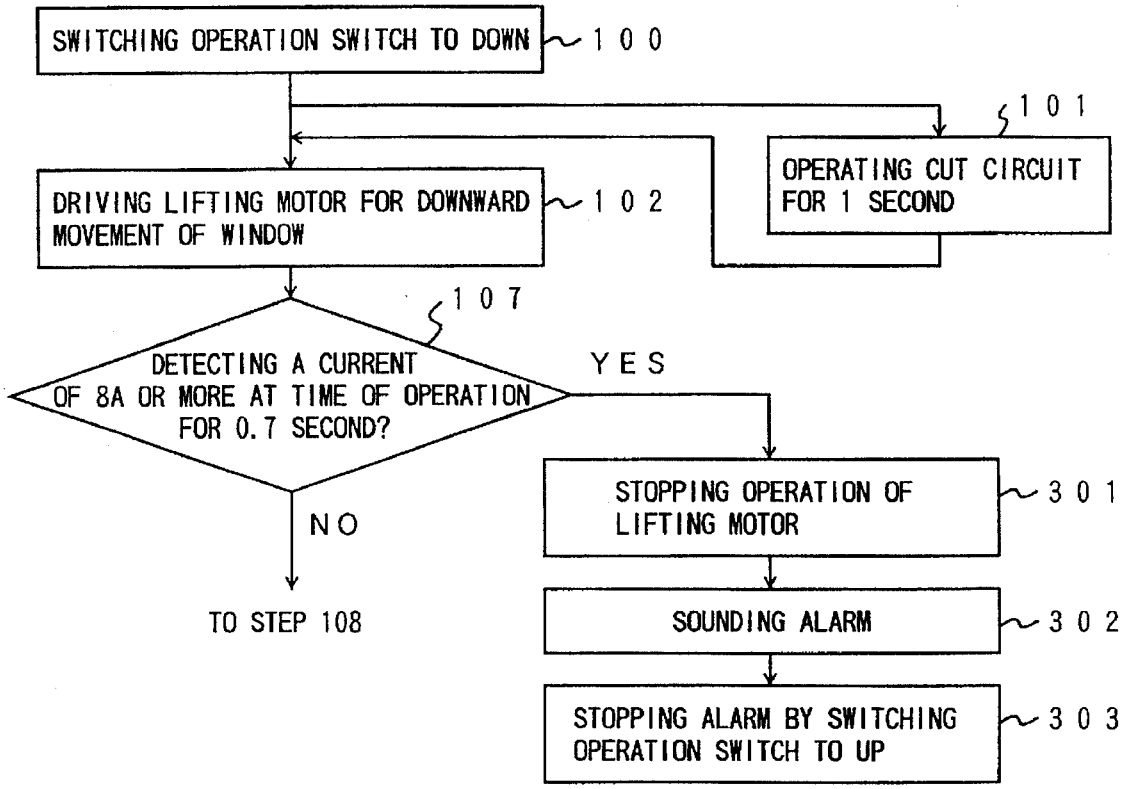
FIG. 6*a* and FIG. 6*b* are flow charts for explaining the operations of a safety circuit and a cut circuit.

In this embodiment, the controller 50 is provided with a safety circuit 56, to eliminate a danger when a man or an object is caught during the automatic closing operation of the window 14. As shown in FIG. 6*a*, the safety circuit 56 activates an alarm circuit 58*a* when the lifting motor 34M is driven to move the window 14 downwardly, by switching the operation switch 51 to DOWN (steps 100 and 102), and an overload current is generated in the lifting motor 34M. The safety circuit 56 receives a load current from the lifting motor 34M and determines whether it is detected that an overload current, so-called surge current, exceeds 8A for 0.7 second or more (step 107). If it is detected (YES), the safety circuit 56 outputs an operation stop signal to the lifting motor 34M to stop it (step 301), and at the same time sounds a built-in alarm in the safety circuit (step 302). When the operation switch 51 is switched to UP, the safety circuit 56 stops sounding the alarm (step 303). Conversely, when it is not detected (NO), the routine proceeds to the step 108, shown in FIG. 2, to perform a regular closing operation. Therefore, if a man or an object is caught between the window 14 and the window frame 16, the window 14 can be automatically stopped and an alarm can be given, thus securing safety. Operation by means of the safety circuit 56 can be applied to the locking motors 41L and 41R. That is, when a finger or an object is caught in a small gap between the window 14 and the window frame 16, the locking motors 41L and 41R are stopped and the alarm is likewise sounded.

Figure 6B:
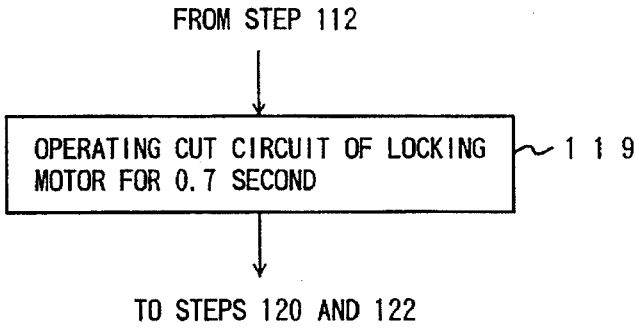

In this way, when an excess load current is detected, the lifting motor 34M and the locking motors 41L and 41R are automatically stopped. However, there is the possibility that a surge current is generated, which activates the safety circuit 56, when a starting load is too large at the time of starting these units. Then, a cut circuit 57 is provided in the safety circuit 56. As shown in FIG. 6*a*, the cut circuit 57 is activated after the operation switch 51 is switched to DOWN so that, even if a surge current beyond a predetermined value is detected, this overload current signal is not applied to the safety circuit 56 for a standby time of about 1 second, which is set at the time of activation (step 101). As for the locking motors 41L and 41R, immediately after the locking motors 41L and 41R are activated, the cut circuit 57 is operated for about 0.7 second, as shown in FIG. 6*b*, to prevent a load current signal from being applied to the safety circuit 56 (step 119).

Figure 7:
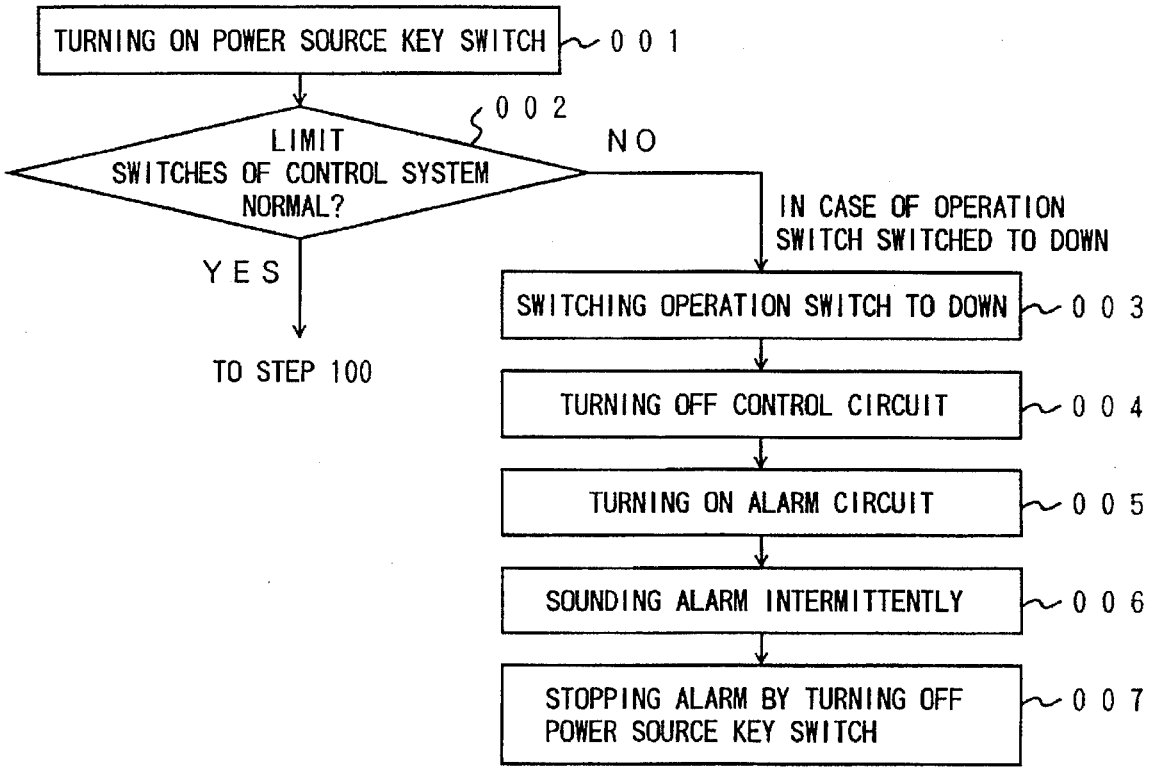
FIG. 7 is a flow chart for explaining the operation of a circuit for detecting a malfunction of the limit switches of the control system.

Further, according to this embodiment, when a power key switch is turned on prior to the opening or closing operation of the window 14, the operation states of the limit switches 47L, 47R, 48L and 48R and the unshown rear limit switch (to be referred to as "limit switches of the control system" hereinafter) of the control system are detected in advance. That is, as shown in FIG. 7, when the power key switch is turned on (step 001), the absence or presence of the malfunctioning limit switches of the control system is determined (step 002). This malfunction decision is performed as follows. The normal ON and OFF states of the limit switches of the control system are prestored so that when signals different from the prestored ON and OFF states are applied to the controller 50 by the opening or closing operation, the limit switches of the control system are determined to be malfunctioning. In this case, when the operation switch 51 is switched to DOWN (step 003), for example, the control circuit of the controller 50 is cut off (step 004), the alarm circuit 58*a* is activated (step 005), and the alarm is sounded (step 006). When the power key switch is cut off, sounding of the alarm is stopped (step 007). On the other hand, when the limit switches are normal, the routine proceeds to the step 100 as shown in FIG. 2. The malfunction decision circuit 58 for the limit switches of the control system is provided in the controller 50 to allow the driver to immediately handle a problem in the equipment and to inactivate the control circuit, thereby securing safety.

According to this embodiment, since the locking units 29L and 29R are activated a predetermined time after the detection of the terminal position for the downward movement of the window 14, it is possible to engage the locking members 44L and 44R with the locking pins 35L and 35R, respectively, after the vibration generated after the window 14 reaches the terminal position of its downward movement thoroughly ends. Therefore, locking inconvenience can be prevented without failure and automation is effected safely. As for locking members 44L and 44R, at the moment when they are engaged with the locking pins 35L and 35R after starting to move, they are stopped temporarily, during which slack is removed by winding up the driving cable 28. Therefore, there is no slack in the driving cable 28 during a shutting operation of the window 14, and the driving cable 28 can be driven without failure. There is no operational inconvenience caused by the play allowance of the driving cable 28, even during an opening operation of the window 14.

Since the locking units 29L and 29R of the window 14 can be operated independently, the window 14 is prevented from being pressed against the window frame 16 and locked while it is unbalanced with respect to the window frame 16. If there is a difference in installation error between the locking units 29L and 29R, due to the production accuracies of the window 14 and the driver's cab 12, and the locking units 29L and 29R have production errors themselves, the window 14 can be locked without failure.

Further, the limit positions for the forward movements of the locking units 29L and 29R during the shutting operation are detected by means of the surge currents applied to the locking motors 41L and 41R. However, since a surge current does not rise sharply due to the elasticity of rubber sealing between the window 14 and the window frame 16, no large burden is placed on the locking motors 41L and 41R. Although the limit positions for the backward movements of the locking members 44L and 44R during the shutting force releasing operation are mechanically detected by the limit switches 48L and 48R, respectively, the backwardly moving locking members 44L and 44R do not collide with the bearing member 49L and 49R or the like, and can be stopped without generating a drastic overload current, thereby extending the service lives of the locking motors 41L and 41R.

When a man or an object is caught during the opening or closing operation of the window 14, a load current is generated in the lifting motor 34M. The safety circuit 56 is provided to detect the generation of a load current so as to stop the operation of the lifting motor 34M and sound the alarm. As the result, safer automatic control of the opening and closing of the window is possible. Meanwhile, when a high surge current, which is generated when the lifting motor 34M and the locking motors 41L and 41R are activated, is detected, the cut circuit 57 is provided to prevent the functioning of the safety circuit 56 for a very short time at the time of activation, thereby preventing operational inconvenience caused by securing safety.

Further, since the malfunction decision circuit 58 for the limit switches of the control system is provided, safety during the opening or closing operation of the window 14 is high.

A detailed description of a second embodiment of the present invention is set forth with reference to FIGS. 14 and 15, in which like symbols represent the same or similar elements and their descriptions are omitted.

Figure 14:
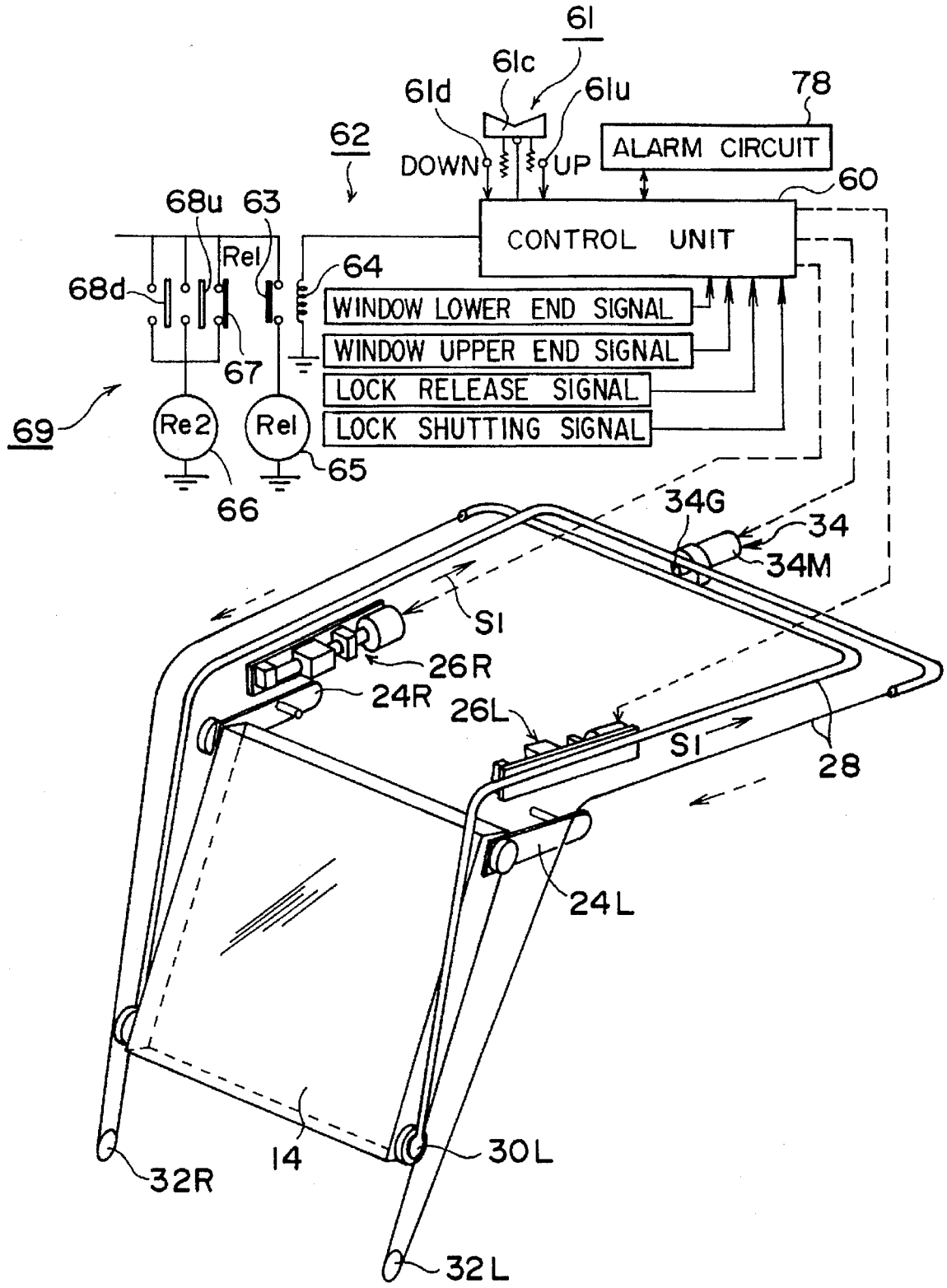
FIG. 14 is a schematic diagram of the configuration of an apparatus for automatically controlling the opening and closing of the window according to a second embodiment of the present invention.
Figure 15:
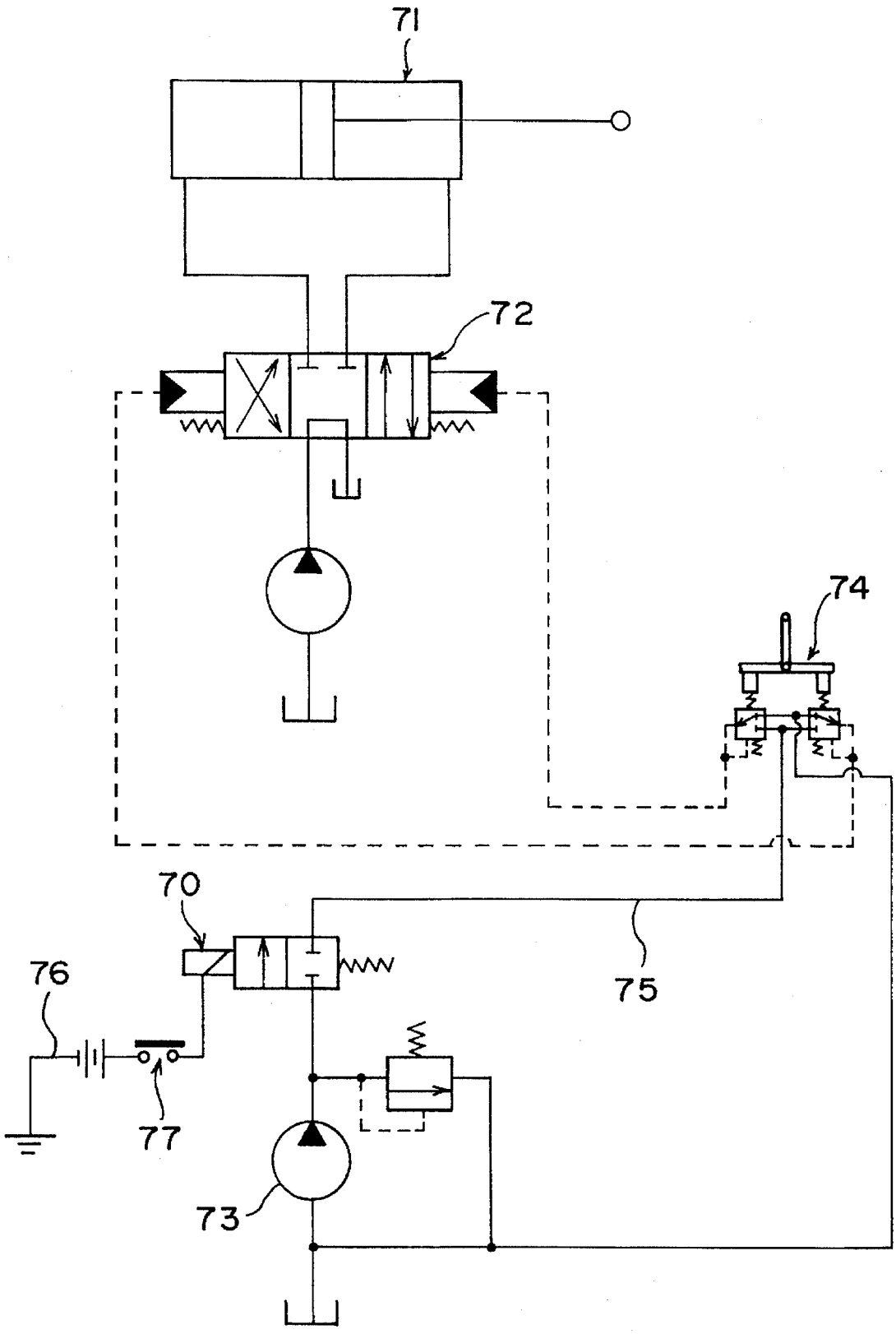
FIG. 15 is a diagram for explaining a hydraulic circuit of a working machine controlled by the control unit of FIG. 14.

The controller of this embodiment comprises a control unit 60 for controlling the opening and closing of the window 14 based on an input from the operation switch 61, as shown in FIG. 14. That is, the motor 34M is driven for the upward movement of the window 14 by turning on the upward operation with the operation switch 61, and driven for the downward movement of the window 14 by turning on the downward operation.

A signal indicating that the window 14 has reached the terminal position of its upward movement by the opening operation, a signal for detecting that the window 14 has reached the terminal position of its downward movement by the closing operation and is in the shutting standby state, a signal for detecting the shutting state in which the pressing means 26L and 26R have moved the slide plates 24L and 24R forwardly, and a signal for detecting that the locking members 44L and 44R are separated from the slide plates 24L and 24R and have reached the limit positions of their backward movements, are applied to the control unit 60.

In this embodiment, the operation switch 61 is formed of a deadman switch. That is, the operation switch 61 has a switch terminal 61*u* for upward movement, a switch terminal 61*d* for downward movement, and a switch piece 61*c* which is urged toward a neutral direction by a neutral return spring and which communicates with a common terminal. An operation signal is generated only by maintaining the pressing of the switch piece 61*c* toward either one of the switch terminals 61*u* and 61*d*. According to the operation signal, the control unit 60 drives the lifting motor 34M to rotate for the opening or closing operation of the window 14.

Further, the control unit 60 is provided with a circuit for cutting off the hydraulic circuit of a working machine when the operation switch 61 is pressed toward the upward movement side or the downward movement side, so that the opening or closing operation of the window 14 and the operation of the working machine can be selectively performed. In other words, the control unit 60 comprises a switch operation signal output circuit 62, for generating a signal when the switch piece 61*c* is kept pressed toward either one of the switch terminals 61*u* and 61*d*, as well as a relay circuit 69 including a relay switch 64 structured such that it is activated by the switch operation signal to connect a make contact point 63. To the relay circuit 69 is connected a first relay switch 65, which is energized and activated by the operation of the make contact point 63; and a second relay switch 66 is provided in parallel with the first relay switch 65. The second relay switch 66 is cut off by a break contact point 67, which is activated by the first relay switch 65, and is energized by the make contact points 68*u* and 68*d*, which are activated by a signal from the control unit 60 indicative of the upper end position of the window 14 or a signal indicative of the lower end position of the window 14.

Meanwhile, the hydraulic circuit of the working machine is provided with an electromagnetic switch valve 70, which is able to make a pilot hydraulic circuit conductive when the second relay switch 66 is energized. The electromagnetic switch valve 70, as shown in FIG. 15, is a path for feeding a pilot pressure to a direction switch valve 72, which is provided in the working oil feed and discharge path to the working machine cylinder 71, and is connected to a pilot pressure feed circuit 75 extending from a pilot pump 73 to an operation lever 74. A pilot pressure, which is in proportion to the operation amount of the operation lever 74, is introduced into the direction switch valve 72, and the working machine cylinder 71 is driven according to the operation direction and the amount of operation. As the electromagnetic switch valve 70 cuts off the introduction of this pilot pressure, it is possible to operate the working machine cylinder 71 when the electromagnetic switch valve 70 is opened, and it is impossible to operate the working machine cylinder 71 when the valve 70 is closed. To the drive circuit of the electromagnetic switch valve 70 is connected a make contact point 77, which is operated by the second relay switch 66 so that, when a switch-on signal is provided to the switch operation signal output circuit 62 shown in FIG. 14, the make contact point 77 is broken to set the electromagnetic switch valve 70 to a pilot pressure cut-off state. Because of this, it is impossible to operate the working machine cylinder 71 during the automatic opening or closing operation of the window 14, and the operation of the working machine and the opening or closing operation of the window 14 cannot be performed at the same time. The relay circuit 69 is provided with make contact points 68*u* and 69*d* which are operative in response to a detection signal indicating that the window 14 has reached the open position or the shut position. When the window 14 reaches the open position or the shut position, the second relay switch 66 is activated, the make contact point 77 of the second relay switch is connected, and the electromagnetic switch valve 70 is reset to a conductive state.

Further, the control unit 60 is provided with an alarm circuit 78 as an alarm means. The alarm circuit 78 becomes operative and sounds the alarm buzzer when the input of the operation switch 61 is stopped halfway and the window 14 does not reach either the open position or the shut position. This configuration is made possible by combining the switch ON/OFF states of the limit switches, for detecting the positions of the operation switch 61 and the window 14, in the form of logic circuits.

According to this embodiment, since the operation switch 61 of the window 14 is formed of a deadman switch, the opening or closing operation of the window 14 is performed only when the driver keeps pressing the switch 61, thereby providing a high safety. Further, when the opening or closing operation is interrupted, the alarm buzzer sounds and the driver can inspect the operation immediately, thereby preventing damage to the equipment. Particularly, when a signal for the opening or closing operation of the window 14 is obtained, the control unit 60 switches the electromagnetic switch valve 70 to cut off the circuit, thereby making impossible the simultaneous operation of the working machine cylinder 71 and fully securing the safety of the driver. In this embodiment, the relay circuit 69 is used to operate the electromagnetic switch valve 70 by detecting an operation signal from the operation switch 61. This can be implemented by other arbitrary configurations having a similar function to this. The present invention is applied to the working machine cylinder 71 in this embodiment, but can be applied to the wheel driving system or the pump driving system of the vehicle.

A description of a third embodiment of the present invention is set forth with reference to FIGS. 16*a* to 19*b*, in which like symbols represent the same or similar elements and their descriptions are omitted.

Figure 16A:
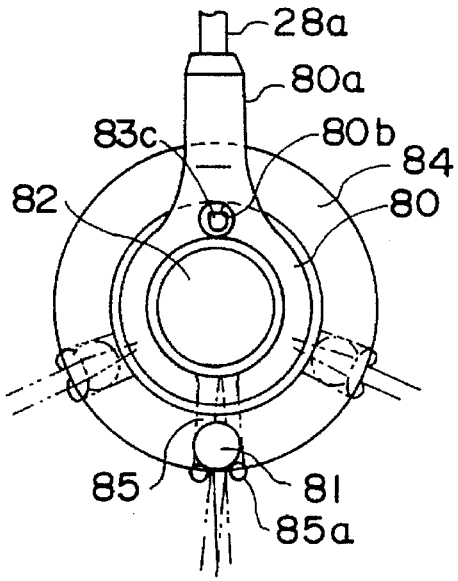
FIG. 16*a* is a front view of the connection between a geared cable and a return cable according to a third embodiment of the present invention.
Figure 16B:
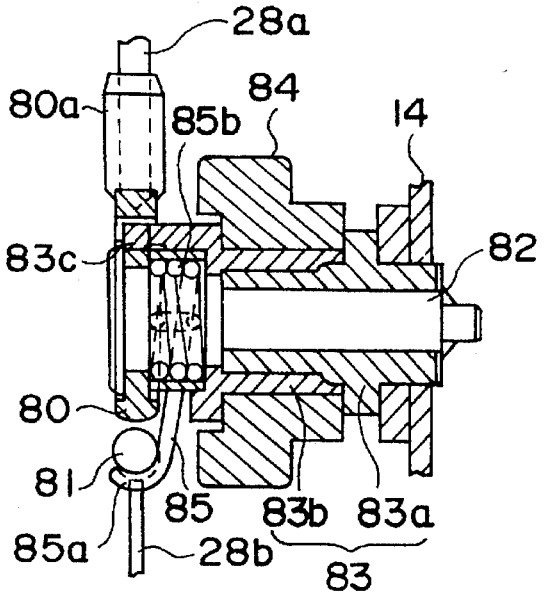
FIG. 16*b* is a sectional view of the connection when seen from its side.

This embodiment is an apparatus for opening and closing the window 14 by means of the reciprocating motion of a geared cable 28*a*, where the geared cable 28*a* and the return cable 28*b* are interconnected in a loop form. As shown in FIGS. 16*a* and 16*b*, the geared cable 28*a* is connected to the grommet 80, and an end portion of the return cable 28*b* is connected to the cable end ball 81. The grommet 80 and the cable end ball 81 are supported by a head portion of the pin 82, inserted into the hole of the grommet 80, and one end of the boss 83 provided around the pin 82. A roller 84 is installed around one end of the boss 83 so that it can rotate, and the other end of the boss 83 is fixed to the window 14.

More specifically, an end portion of the geared cable 28*a* is inserted into and fixed to an external projection portion 80*a* of a ring-shaped grommet 80 having a hole formed at the center thereof, and an end portion of the return cable 28*b* is fusion connected to the cable end ball 81. The main body of the holder 85 is formed like a coil from a single spring material and its projecting ends 85*a* are formed outwardly like a saucer using part of the spring material. The cable end ball 81 is supported by the projecting ends 85*a*. The pin 82 is inserted into the hole of the grommet 80 and the coil, and both ends of the coil of the holder 85 are fixed in grooves provided on opposite sides of the pin 82. The pin 82 is surrounded by the boss 83 which consists of an inner cylinder 83*a* and an outer cylinder 83*b*, which is provided around the inner cylinder 83*a*. The grommet 80 and the coil of the holder 85 are held between the head portion of the pin 82 and the outer cylinder 83*b*. Further, the grommet 80 and the boss 83 are positionally fixed when a projection portion 83*c* of the outer cylinder 83*b* fits in a small hole 80*b* formed in the grommet 80. The roller 84, which rotates along the guide rail, is provided around one end of the outer cylinder 83*b*, and the other end of the inner cylinder 83*a* is fixed to the window 14 by a bracket. The outer surface of the coil of the holder 85 is guided by a spacer 85*b*.

A description of the function of this embodiment is set forth below. When the window 14 is opened or closed, the geared cable 28*a* and the return cable 28*b* need to rotate separately so that they are not twisted. The direction of the boss 83 needs to be fixed to prevent the window 14 from being shaky during the opening operation. According to the configuration of this embodiment, the geared cable 28*a* can rotate by itself while controlling the boss 83 with upward tensile force, and the roller 84 can rotate by itself. The return cable 28*b* can rotate by itself by rotating the pin 82 with downward tensile force, or the spring force of idle pulleys 32L and 32R shown in FIG. 10 through the holder 85. The holder 85 makes the centers of the geared cable 28*a* and the return cable 28*b* coincide with each other to prevent the cables 28*a* and 28*b* from falling off of the guide rails.

Figure 19A:
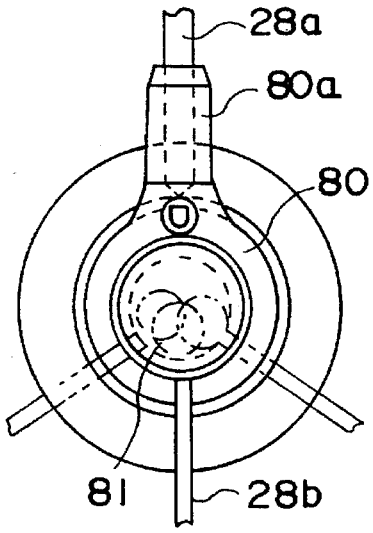
FIG. 19*a* is a plan view of the connection between the geared cable and the return cable according to an application example of the third embodiment.
Figure 19B:
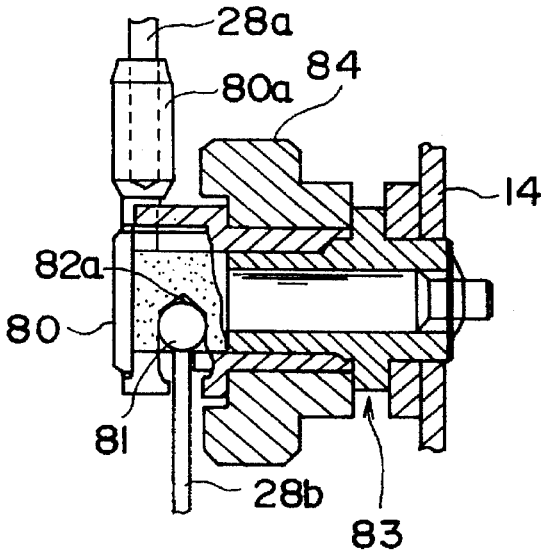
FIG. 19*b* is a sectional view of the connection when seen from its side.
Figure 17A:
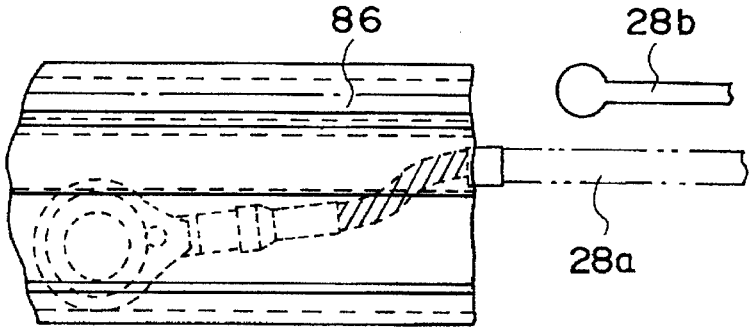
FIG. 17*a* is a diagram for explaining the interconnection of the geared cable and the return cable of FIG. 16*a;*
Figure 17B:
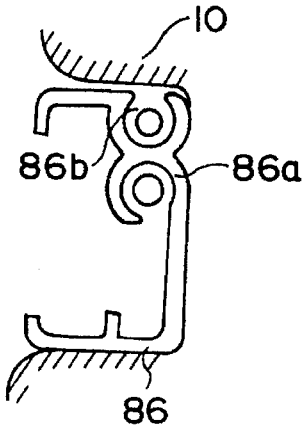
FIG. 17*b* is a diagram for explaining the interconnection when seen from its side.
Figure 18A:
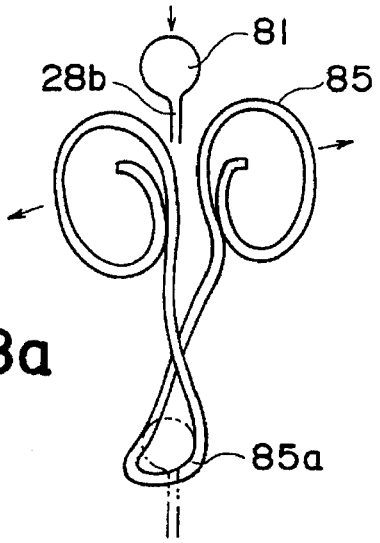
FIG. 18*a* is a diagram showing the cable end ball of FIG. 16*a* before insertion.
Figure 18B:
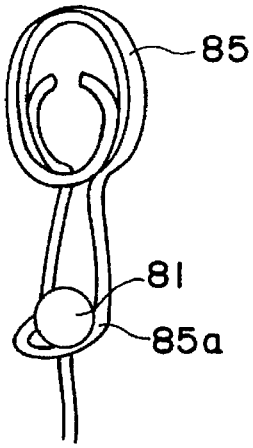
FIG. 18*b* is a diagram showing the cable end ball after insertion.
Figure 18C:
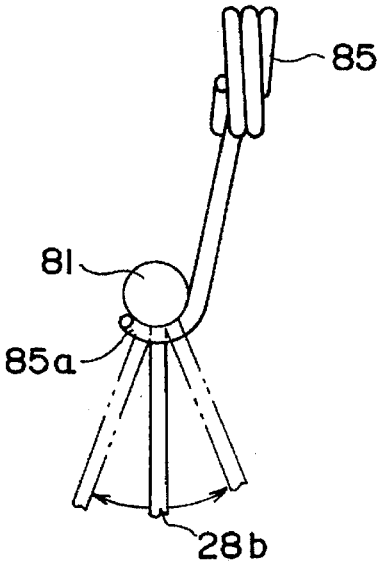
FIG. 18*c* is a diagram showing the cable end ball swinging in all directions.

The reason why an end portion of the geared cable 28*a* is made the grommet 80 and the end portion of the return cable 28*b* is made the cable end ball 81 is that, in the step for passing both cables through the guide rail 86 at the time of assembly, as shown in FIGS. 17*a* and 17*b*, a tube 86*b* for passing the return cable 28*b* therethrough is positioned on the side surface of the driver's cab 12 because the return cable 28*b* is too large to pass through the grommet 80. In contrast, the reason why the end portion of the geared cable 28*a* is made the grommet 80 is that there is room within the guide rail 86, and the geared cable 28*a* can be easily installed or removed from the tube 86*a* by bending it at the time of assembly. In the procedure for inserting the cable end ball 81 into the holder 85, a gap is formed between coils on both sides by pulling the holder 85 in the right and left directions indicated by arrows shown in FIG. 18*a*. The cable end ball 81 is then inserted into the top of a saucer-like projection portion 85*a* and stays, as shown in FIG. 18*b*. The gap in the holder 85 is closed by spring force so that the cable end ball 81 is not pulled up and can have an universal function in that it can swing back and forth and right and left, as shown in FIG. 18*c*. As a result, the return cable 28*b* is not twisted. FIGS. 19*a* and 19*b* show application examples of this embodiment in which a storage hole 82*a* is formed in part of the pin 82 to directly store the cable end ball 81 in the storage hole 82*a*, in place of the holder 85. Although the centers of the geared cable 28*a* and the return cable 28*b* are separated from each other, the same effect as that of this embodiment is provided.

This embodiment eliminates a forming step, required at the time of interconnecting the geared cable 28*a* and the return cable 28*b* of the apparatus for opening and closing the window, to facilitate interconnection assembly work, and is free from the generation of curves in the cables 28*a* and 28*b* during the opening and closing operations and a reduction in strength.

A description of a fourth embodiment of the present invention is set forth with reference to FIGS. 20 to 23*c*, in which like symbols represent the same or similar elements of the first embodiment and their descriptions are omitted.

Figure 20:
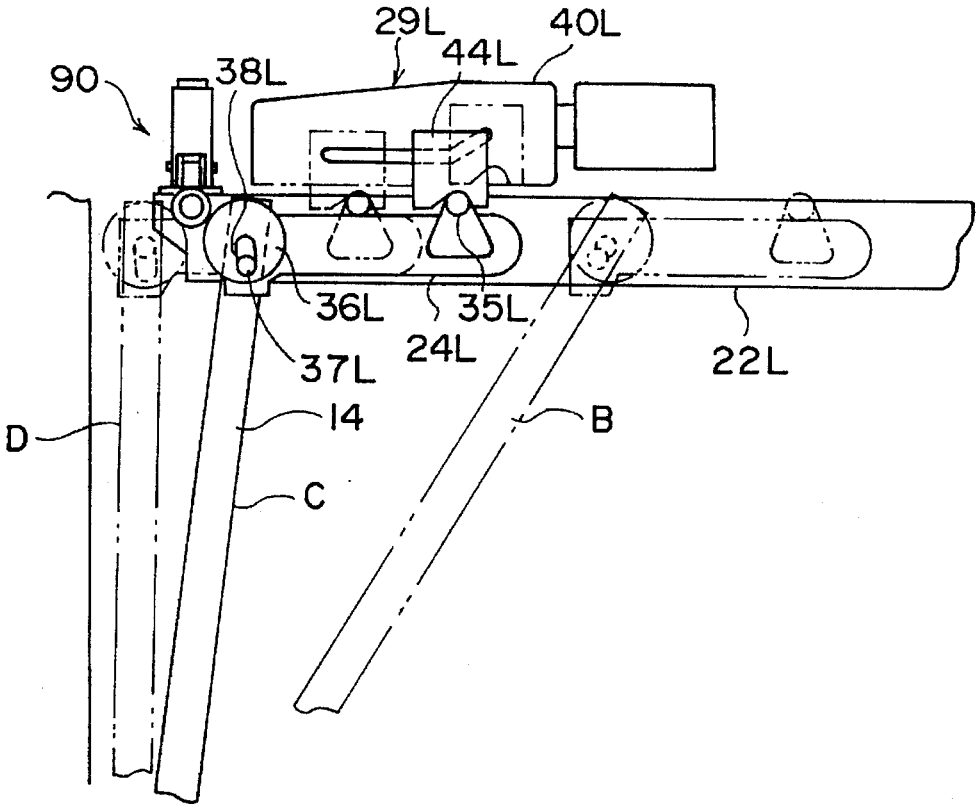
FIG. 20 is a side view of an apparatus for opening and closing the window provided with a detent unit according to a fourth embodiment.

The window 14, as shown in FIG. 20, moves from the position B in the middle of the closing operation of the window 14 to the shutting standby position C, and the locking member 44L, installed on the cam plate 40L of the locking unit 29L, engages with the locking pin 35L provided on the slide plate 24L. A detent unit 90 is installed on the upper rim of the guide rail 22L at the shutting standby position C.

Figure 21:
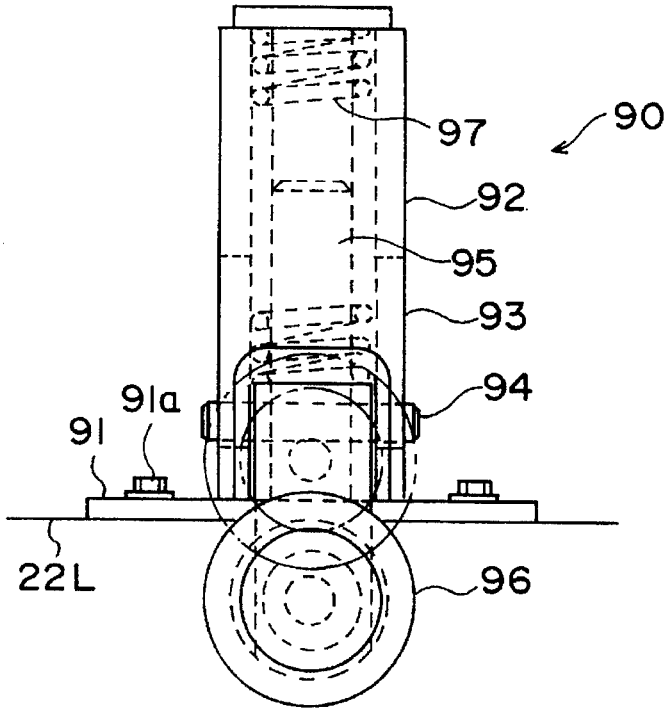
FIG. 21 is a front view of the detent unit.
Figure 24A:
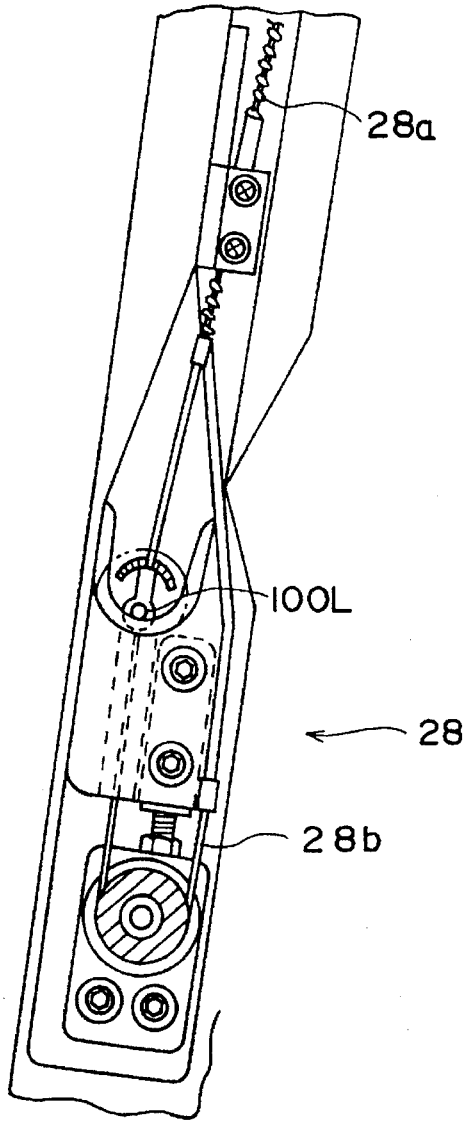
FIG. 24a PRIOR ART
FIG. 24*a* is a diagram for explaining the geared cable and the return cable of the prior art.
Figure 24B:
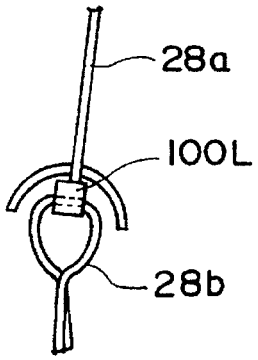
FIG. 24b PRIOR ART
FIG. 24*b* is a diagram for explaining the state of the fixed return cable of the prior art.
Figure 25:
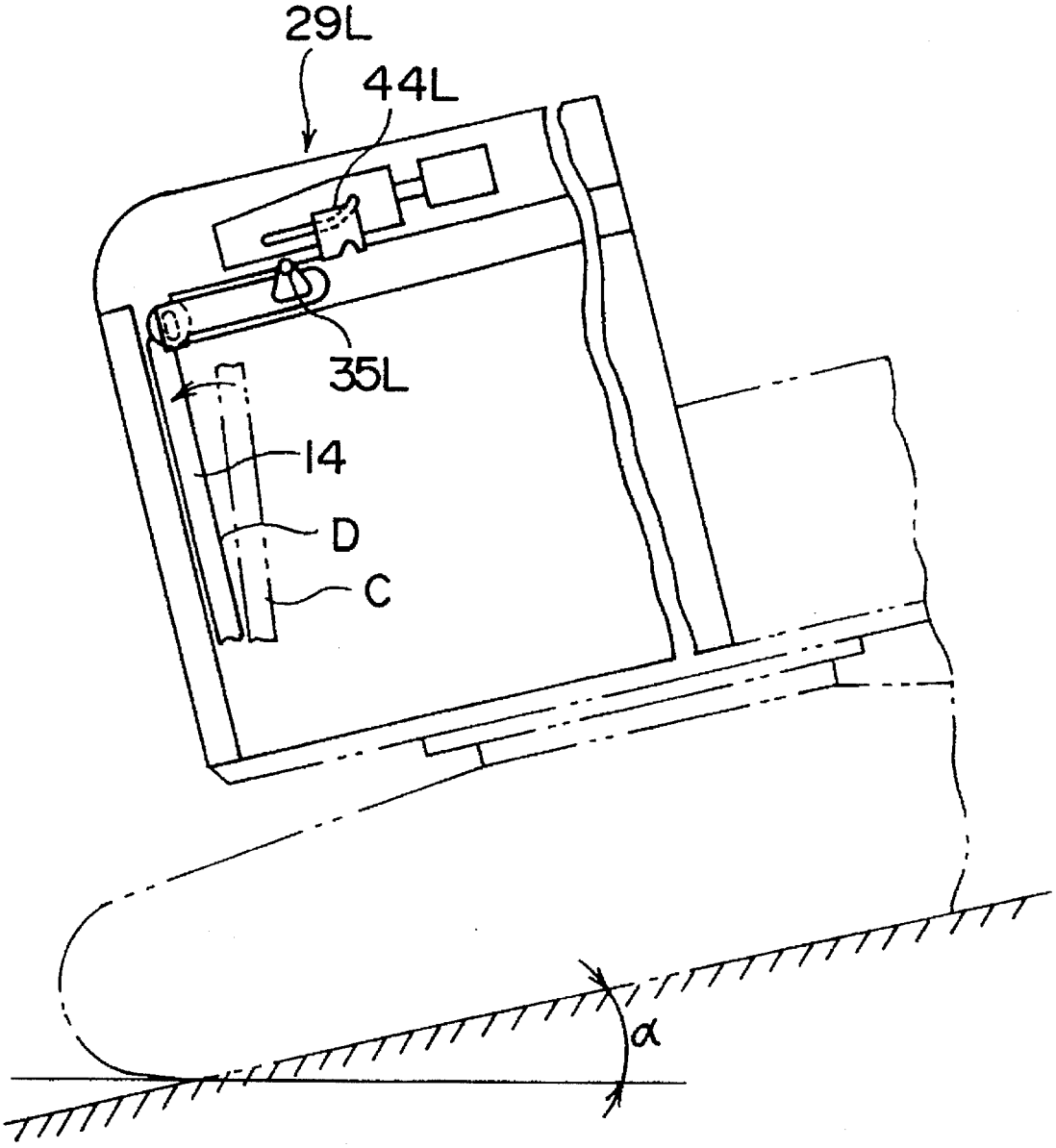
FIG. 25 PRIOR ART
FIG. 25 is a diagram for explaining the window opening and closing apparatus of the prior art which is falling on a slope.

The detent unit 90 comprises a case 92, installed upright by a bracket 91 fixed by bolts 91*a* to the upper rim of the guide rail 22L, as shown in FIGS. 21 and 22. In the case 92, a leg 95 is loosely installed by a shaft pin 94, inserted into an elongated hole 93 so that it can go in and out of a lower part of the case 92, and a detent roller 96 is rotatably provided at a lower end of the leg 95. On the other hand, an upper end of the leg 95 is urged by a spring 97 so that the detent roller 96 is moved vertically by the expansion and contraction of the spring 97.

A description of the function of this embodiment is set forth below. When the window 14 is moved to the shutting standby position C, the locking member 44L, installed on the cam plate 40L of the locking unit 29L, engages with the locking pin 35L of the slide plate 24L. In front of the guide roller 36L of the window 14 at the shutting standby position C, the detent roller 96 of the detent unit 90 projects by the urging force of the spring 97. The detent roller 96 prevents the window 14 from moving to the shut position D by its own weight, generated by its inclination, and maintains engagement between the locking member 44L and the locking pin 35L. Shutting the window 14 by moving it to the shut position D is possible only when the guide roller 36L moves the detent roller 96 upwardly by means of the pressure of the locking member 44L.

FIGS. 23*a*, 23*b* and 23*c* show the time-dependent function of the detent unit 90 when the window 14 moves from the shutting standby position C to the shut position D. When the window 14 moves in an opposite direction, from the shut position D to the shutting standby position C, the guide roller 36L moves the detent roller 96 upwardly by means of the pressure of the locking member 44L. This embodiment is able to perform window opening and closing operations smoothly without failure by means of the detent unit 90, even during a window closing operation while the vehicle is moving downwardly on a slope.

INDUSTRIAL FEASIBILITY

This invention is useful as a method of automatically controlling the opening and closing of the window of a working vehicle and an apparatus for practicing the method, which are capable of carrying out the opening and closing operations of the window and stopping the operation of the locking units without failure, and makes impossible the simultaneous operation of a working machine during the opening or closing operation of the window, thereby providing a high operability and a high safety, and yet facilitates the interconnection assembly of the driving cable.

What is claimed is:

1. In a method of automatically controlling the opening and closing of a window of a driver's cab of a working vehicle, wherein in a window opening operation said window is moved in an upward movement from a closed position in contact with a window frame to an opened position adjacent a top wall of the driver's cab, wherein in a window closing operation said window is moved in a downward movement from said opened position to a lower terminal position for said downward movement, wherein during a window closing operation said window is pressed from said lower terminal position into contact with said window frame, and wherein said window is driven between said closed position and said opened position by a driving cable so that the resulting movement of said window between said closed position and said opened position includes a vertical movement, the improvement comprising at least one series of steps from the following six series of steps:

(a) during said window closing operation:

detecting when said window reaches said lower terminal position for said downward movement of the window during said window closing operation, and then pressing said window from said lower terminal position into contact with said window frame;

(b) during said window closing operation:

detecting when said window reaches said lower terminal position for said downward movement of the window during said window closing operation, initiating the pressing of said window from said lower terminal position into contact with said window frame;

interrupting the pressing of said window from said lower terminal position into contact with said window frame;

removing any slack from said driving cable, and then re-initiating the pressing of said window from said lower terminal position into contact with said window frame;

(c) during said window closing operation:

supplying driving currents to locking motors to move locking members to press said window from said lower terminal position into contact with said window frame during said window closing operation, detecting the thus supplied driving currents of the locking motors during said window closing operation, and stopping a locking motor when the thus detected driving current of the locking motor exceeds a threshold value;

(d) during said window closing operation:

supplying driving currents to locking motors to move locking members forwardly to provide closing forces to press said window from said lower terminal position into contact with said window frame during said window closing operation, detecting the driving currents of the locking motors during the pressing of said window from said lower terminal position into contact with said window frame, and stopping a locking motor when the thus detected driving current of the locking motor exceeds a threshold value;

then supplying driving currents to the locking motors to move the locking members rearwardly in a closing forces releasing operation, detecting limit positions for backward movements of the locking members during the closing forces releasing operation, and stopping said locking motors when the locking members are detected at the limit positions for backward movements of the locking members;

(e) during said vertical movement of said window:

supplying a driving current to a driving motor for driving said driving cable, detecting said driving current supplied to said driving motor during said vertical movement of the window, and stopping said driving motor when a thus detected driving current to said driving motor exceeds a threshold value; and (f) during one of said window closing operation and said window opening operation:

driving said driving cable, to perform said window opening operation or said window closing operation, by actuating a deadman switch circuit, producing a switch operation signal when said deadman switch circuit is actuated, and preventing any operation of a working machine of the working vehicle while the switch operation signal is present, so that an operation of said working machine cannot be simultaneously performed with said window opening operation or said window closing operation.

2. A method in accordance with claim 1, wherein said improvement comprises said series of steps (a).

3. A method in accordance with claim 2, wherein said improvement comprises said series of steps (a), and wherein said step of then pressing said window from said lower terminal position into contact with said window frame in said series of steps (a) is performed after a predetermined time delay after the detection of the window at its lower terminal position for the downward movement.

4. A method in accordance with claim 1, wherein said improvement comprises said series of steps (b).

5. A method in accordance with claim 1, wherein said improvement comprises said series of steps (c).

6. A method in accordance with claim 1, wherein said improvement comprises said series of steps (c);

wherein said step of supplying driving currents to locking motors in said series of steps (c) comprises:

supplying driving currents to left and right locking motors to independently move left and right locking members to independently press left and right upper portions of said window from said lower terminal position into contact with said window frame during said window closing operation;

wherein said step of detecting the thus supplied driving currents in said series of steps (c) comprises:

independently detecting the thus supplied driving currents of the left and right locking motors during said window closing operation; and wherein said step of stopping a locking motor in said series of steps (c) comprises:

stopping the left locking motor when the thus detected driving current of the left locking motor exceeds a threshold value, and stopping the right locking motor when the thus detected driving current of the right locking motor exceeds a threshold value.

7. A method in accordance with claim 6, wherein said improvement further comprises:

in said window opening operation:

supplying driving currents to the left and right locking motors to move the left and right locking members rearwardly in a closing forces releasing operation, independently detecting limit positions for backward movements of the left and right locking members during the closing forces releasing operation, and stopping the left locking motor when the left locking member is detected at the limit position for backward movement of the left locking member, and stopping the right locking motor when the right locking member is detected at the limit position for backward movement of the right locking member.

8. A method in accordance with claim 1, wherein said improvement comprises said series of steps (d).

9. A method in accordance with claim 1, wherein said improvement comprises said series of steps (e).

10. A method in accordance with claim 1, wherein said improvement comprises said series of steps (e); and wherein said step of supplying a driving current to said driving motor comprises:

activating a driving motor for driving said driving cable by supplying a driving current to said driving motor; and wherein said step of stopping said driving motor in said series of steps (e) is performed when, after a predetermined time after an activation of the driving motor, a thus detected driving current to said driving motor exceeds a threshold value.

11. A method in accordance with claim 1, wherein said improvement comprises said series of steps (f).

12. A method in accordance with claim 1, wherein said improvement comprises said series of steps (b), said series of steps (d), said series of steps (e), and said series of steps (f).

13. In an apparatus comprising a working vehicle having:

a driver's cab, said cab having a wall with a window frame therein, a window corresponding to said window frame, a top wall, guide rails connected to said cab and extending between said window frame and said top wall;

a driving cable for moving said window along said guide rails between a closed position in contact with said window frame and an opened position adjacent said top wall, wherein in a window opening operation said window is moved by said driving cable in an upward movement from said closed position to said opened position, wherein a movement of said window between said closed position and said opened position includes a vertical movement, and wherein in a window closing operation said window is moved by said driving cable in a downward movement from said opened position to a lower terminal position for said downward movement;

a driving motor for driving said driving cable; and locking units for pressing said window from said lower terminal position into contact with said window frame during a window closing operation;

the improvement comprising at least one combination of elements from the following eight combinations of elements:

(a) detectors for detecting when said window reaches said lower terminal position for the downward movement of the window during said window closing operation and for providing a detection signal representative thereof, and means responsive to said detection signal for causing said locking units to press said window into contact with said window frame after said window is detected at said lower terminal position;

(b) detectors for detecting when said window reaches said lower terminal position for the downward movement of the window during said window closing operation and for providing a detection signal representative thereof, and a controller which receives said detection signal, which initiates the pressing of said window from said lower terminal position into contact with said window frame in response to the receipt of said detection signal, which interrupts the pressing of said window from said lower terminal position into contact with said window frame, which actuates said driving motor to remove any slack from said driving cable during the resulting interruption of the pressing of said window into contact with said window frame, and which then reinitiates the pressing of said window into contact with said window frame;

(c) said locking units containing locking members and locking motors for moving said locking members to press said window from said lower terminal position into contact with said window frame during said window closing operation, means for supplying driving currents to said looking motors, detectors for detecting the driving currents of the locking motors during said window closing operation, and a controller for stopping a locking motor when the thus detected driving current of that locking motor exceeds a threshold value;

(d) said locking units containing locking members and locking motors for moving the locking members to press said window from said lower terminal position into contact with said window frame during said window closing operation, means for supplying driving currents to said locking motors to move locking members forwardly to provide closing forces to press said window from said lower terminal position into contact with said window frame during said window closing operation, detectors for detecting the thus supplied driving currents to the locking motors during the pressing of said window from said lower terminal position into contact with said window frame, detectors for detecting limit positions for backward movements of the locking members during a closing forces releasing operation, and a controller for stopping a locking motor when the thus detected driving current of that locking motor exceeds a threshold value, then for supplying driving currents to the locking motors to move the locking members rearwardly in said closing forces releasing operation, and for stopping said locking motors when the locking members are detected at the limit positions for backward movements of the locking members;

(e) means for supplying a driving current to said driving motor for driving said driving cable, a detector for detecting said driving current supplied to said driving motor during said vertical movement of the window, and a controller for stopping said driving motor when a thus detected driving current to said driving motor exceeds a threshold value;

(f) a deadman switch circuit for actuating said driving motor to perform at least one of said window opening operation and said window closing operation, and for producing a switch operation signal when said deadman switch circuit is actuated, and a controller for preventing any operation of a working machine of the working vehicle while the switch operation signal is present, so that an operation of said working machine cannot be simultaneously performed with said window opening operation or said window closing operation;

(g) said driving cable having a geared cable portion and a return cable portion, with an end portion of said geared cable portion being connected to a grommet, with an end portion of said return cable portion being connected to a cable end ball, said grommet and said cable end ball being supported by a head of a pin positioned in a hole of said grommet and one end of a boss provided around the pin, with another end of said boss being fixed to said window, and with a roller rotatably installed around said boss; and (h) each of said locking units containing a locking member, a locking motor for moving the locking member to press said window from said lower terminal position into contact with said window frame during said window closing operation, a detent unit provided on an upper rim of a guide rail at a shutting standby position, and a slide plate installed on an upper end of the window and having a locking pin, whereby a locking member of a locking unit can engage a locking pin of the associated slide plate, and whereby the detent unit maintains engagement between a locking member and the associated locking pin when the window is pressed from a shutting standby position to a shut position.

14. Apparatus in accordance with claim 13, wherein said improvement comprises said combination (a).

15. Apparatus in accordance with claim 14, wherein said means responsive to said detection signal for causing said locking units to press said window from said lower terminal position into contact with said window frame after said window is detected at said lower terminal position comprises a delay circuit for providing a predetermined time lag after the lower terminal position for the downward movement of the window during said window closing operation is detected before the locking units press said window into contact with said window frame.

16. Apparatus in accordance with claim 13, wherein said improvement comprises said combination (b).

17. Apparatus in accordance with claim 13, wherein said improvement comprises said combination (c).

18. Apparatus in accordance with claim 13, wherein said improvement comprises said combination (c);

wherein said locking units contain left and right locking members and left and right locking motors for moving the left and right locking members to press left and right portions of said window from said lower terminal position into contact with said window frame during said window closing operation;

wherein said means for supplying driving currents comprises:

means for independently supplying driving currents to said left and right locking motors;

wherein said detectors comprise:

detectors for independently detecting the driving currents of the left and right locking motors during said window closing operation; and wherein said controller comprises:

a controller for stopping the left locking motor when the thus detected driving current of the left locking motor exceeds a threshold value, and for stopping the right locking motor when the thus detected driving current of the right locking motor exceeds a threshold value.

19. Apparatus in accordance with claim 13, wherein said improvement comprises said combination (d).

20. Apparatus in accordance with claim 13, wherein said improvement comprises said combination (e).

21. Apparatus in accordance with claim 13, wherein said improvement comprises said combination (e);

wherein said means for supplying a driving current comprises means for activating said driving motor by supplying a driving current to said driving motor for driving said driving cable; and wherein said controller comprises a controller for stopping said driving motor when, after a predetermined time after an activation of the driving motor, a thus detected driving current to said driving motor exceeds a threshold value.

22. Apparatus in accordance with claim 13, wherein said improvement comprises said combination (f).

23. Apparatus in accordance with claim 22, wherein said improvement further comprises:

said controller being provided with an alarm circuit which is activated when the deadman switch circuit is turned off during said window opening operation or said window closing operation.

24. Apparatus in accordance with claim 13, wherein said improvement comprises said combination (g).

25. Apparatus in accordance with claim 13, wherein said improvement comprises said combination (h).

26. Apparatus in accordance with claim 25, wherein said detent unit comprises a case which is installed upright on an upper rim of a guide rail, a leg is loosely installed in said case in such a manner that the leg can move in and out of a lower portion of the case, and a detent roller is provided at a lower end of the leg in such a manner that said detent roller and said leg can move vertically.

27. Apparatus in accordance with claim 13, wherein said improvement comprises said combination (b), said combination (d), said combination (e), said combination (f), said combination (g), and said combination (h).

* * * * *